US005251649A

United States Patent [19]

Cho et al.

[11] Patent Number: 5,251,649

[45] Date of Patent: Oct. 12, 1993

[54] PROCESS FOR IMPREGNATION AND EXPANSION OF TOBACCO

[75] Inventors: Kwang H. Cho, Midlothian; Thomas J. Clarke; Joseph M. Dobbs, both of Richmond; Eugene B. Fischer, Chester; Jose M. G. Nepomuceno, Beaverdam; Ravi Prasad, Midlothian, all of Va.

[73] Assignee: Philip Morris Incorporated, New York, N.Y.

[21] Appl. No.: 717,064

[22] Filed: Jun. 18, 1991

[51] Int. Cl.[5] ..... A24B 3/18

[52] U.S. Cl. ..... 131/296; 131/291; 131/292; 131/900

[58] Field of Search ..... 131/291, 296, 900, 292, 131/301

[56] References Cited

U.S. PATENT DOCUMENTS

| | | | |
|---|---|---|---|
| Re. 32,013 | 10/1985 | de la Burde et al. | 131/291 |
| Re. 32,014 | 10/1985 | Sykes et al. | 131/900 |
| 1,789,435 | 1/1931 | Hawkins . | |
| 1,924,827 | 8/1933 | Anderson . | |
| 2,344,106 | 3/1944 | Reed | 131/136 |
| 3,771,533 | 11/1973 | Armstrong et al. | 131/140 |
| 4,235,250 | 11/1980 | Utsch | 131/140 |
| 4,250,898 | 2/1981 | Utsch et al. | 131/140 |
| 4,253,474 | 3/1981 | Hibbitts et al. | 131/296 |
| 4,258,729 | 3/1981 | de la Burde et al. | 131/140 |
| 4,289,148 | 9/1981 | Ziehn | 131/291 |
| 4,333,483 | 6/1982 | de la Burde | 131/352 |
| 4,340,073 | 7/1982 | de la Burde et al. | 131/291 |
| 4,366,825 | 1/1983 | Utsch et al. | 131/296 |
| 4,460,000 | 7/1984 | Steinberg | 131/296 |
| 4,461,310 | 7/1984 | Zeihn | 131/296 |
| 4,523,598 | 6/1985 | Weiss et al. | 131/291 |
| 4,528,994 | 7/1985 | Korte et al. | 131/296 |
| 4,528,995 | 7/1985 | Korte et al. | 131/304 |
| 4,561,452 | 12/1985 | Gahrs | 131/297 |
| 4,577,646 | 3/1986 | Ziehn | 131/296 |
| 4,630,619 | 12/1986 | Korte et al. | 131/296 |
| 4,697,604 | 10/1987 | Brown et al. | 131/296 |
| 4,727,889 | 3/1988 | Niven, Jr. et al. | 131/297 |
| 4,760,854 | 8/1988 | Jewell et al. | 131/291 |
| 4,791,942 | 12/1988 | Rickett et al. | 131/291 |
| 4,898,188 | 2/1990 | Niven, Jr. et al. | 131/296 |
| 4,946,697 | 8/1990 | Payne | 426/445 |
| 5,012,826 | 5/1991 | Kramer | 131/291 |

FOREIGN PATENT DOCUMENTS

| | | |
|---|---|---|
| 0328676 | 8/1989 | European Pat. Off. . |
| 0424778 | 5/1991 | European Pat. Off. . |
| 64-80272 | 3/1989 | Japan . |
| WO90/0966-95 | 6/1990 | PCT Int'l Appl. . |
| 1484536 | 9/1977 | United Kingdom . |
| 2115677 | 9/1983 | United Kingdom . |

OTHER PUBLICATIONS

European Search Report for Application No. 92305534.7 dated Oct. 1, 1992.

"With the Incom System," Reemtsma Tobbaco Products & Technology.

*Primary Examiner*—V. Millin

*Assistant Examiner*—J. Doyle

*Attorney, Agent, or Firm*—William J. McCabe; Walter F. Fasse

[57] ABSTRACT

A process for expanding tobacco is provided which employs carbon dioxide gas. Tobacco temperature and OV content are adjusted prior to contacting the tobacco with carbon dioxide gas. A thermodynamic path is followed during impregnation which allows a controlled amount of the carbon dioxide gas to condense on the tobacco. This liquid carbon dioxide evaporates during depressurization helping to cool the tobacco bed uniformly. After impregnation, the tobacco may be expanded immediately or kept at or below its post-vent temperature in a dry atmosphere for subsequent expansion.

72 Claims, 13 Drawing Sheets

-1- 2241-42
-2- 2244-46
-3- 2247-50
-4- 2251-54

PROCESS FOR IMPREGNATION AND EXPANSION OF TOBACCO

BACKGROUND OF THE INVENTION

This invention relates to a process for expanding the volume of tobacco. More particularly, this invention relates to expanding tobacco using carbon dioxide.

The tobacco art has long recognized the desirability of expanding tobacco to increase the bulk or volume of tobacco. There have been various reasons for expanding tobacco. One of the early purposes for expanding tobacco involved making up the loss of weight caused by the tobacco curing process. Another purpose was to improve the smoking characteristics of particular tobacco components, such as tobacco stems. It has also been desired to increase the filling power of tobacco so that a smaller amount of tobacco would be required to produce a smoking product, such as a cigarette, which would have the same firmness and yet would deliver lower tar and nicotine than a comparable smoking product made of non-expanded tobacco having a more dense tobacco filler.

Various methods have been proposed for expanding tobacco, including the impregnation of tobacco with a gas under pressure and the subsequent release of pressure, whereby the gas causes expansion of the tobacco cells to increase the volume of the treated tobacco. Other methods which have been employed or suggested have included the treatment of tobacco with various liquids, such as water or relatively volatile organic or inorganic liquids, to impregnate the tobacco with the same, after which the liquids are driven off to expand the tobacco. Additional methods which have been suggested have included the treatment of tobacco with solid materials which, when heated, decompose to produce gases which serve to expand the tobacco. Other methods include the treatment of tobacco with gas-containing liquids, such as carbon dioxide-containing water, under pressure to incorporate the gas in the tobacco and when the impregnated tobacco is heated or the ambient pressure reduced the tobacco expands. Additional techniques have been developed for expanding tobacco which involve the treatment of tobacco with gases which react to form solid chemical reaction products within the tobacco, which solid reaction products may then decompose by heat to produce gases within the tobacco which cause expansion of tobacco upon their release. More specifically:

U.S. Pat. No. 1,789,435 describes a method and apparatus for expanding the volume of tobacco in order to make up the loss of volume caused in curing tobacco leaf. To accomplish this object, the cured and conditioned tobacco is contacted with a gas, which may be air, carbon dioxide or steam under pressure and the pressure is then relieved, the tobacco tends to expand. The patent states that the volume of the tobacco may, by that process, be increased to the extent of about 5-5%.

U.S. Pat. No. 3,771,533, commonly assigned herewith, involves a treatment of tobacco with carbon dioxide and ammonia gases, whereby the tobacco is saturated with these gases and ammonium carbamate is formed in situ. The ammonium carbamate is thereafter decomposed by heat to release the gases within the tobacco cells and to cause expansion of the tobacco.

U.S. Pat. No. 4,258,729, commonly assigned herewith, describes a method for expanding the volume of tobacco in which the tobacco is impregnated with gaseous carbon dioxide under conditions such that the carbon dioxide remains substantially in the gaseous state. Pre-cooling the tobacco prior to the impregnation step or cooling the tobacco bed by external means during impregnation is limited to avoid condensing the carbon dioxide to any significant degree.

U.S. Pat. No. 4,235,250, commonly assigned herewith, describes a method for expanding the volume of tobacco in which the tobacco is impregnated with gaseous carbon dioxide under conditions such that the carbon dioxide remains substantially in the gaseous state. During depressurization some of the carbon dioxide is converted to a partially condensed state within the tobacco. That patent teaches that the carbon dioxide enthalpy is controlled in such a manner to minimize carbon dioxide condensation.

U.S. Pat. No. Re. 32,013, commonly assigned herewith, describes a method and apparatus for expanding the volume of tobacco in which the tobacco is impregnated with liquid carbon dioxide, converting the liquid carbon dioxide to solid carbon dioxide in situ, and then causing the solid carbon dioxide to vaporize and expand the tobacco.

SUMMARY OF THE INVENTION

The present process employing saturated carbon dioxide gas in combination with a controlled amount of liquid carbon dioxide, as described below, has been found to overcome the disadvantages of the prior art processes and provides an improved method for expanding tobacco. The moisture content of the tobacco to be expanded is carefully controlled prior to contact with the saturated carbon dioxide gas. The temperature of the tobacco is carefully controlled throughout the impregnation process. Saturated carbon dioxide gas is allowed to thoroughly impregnate the tobacco, preferably under conditions such that a controlled amount of the carbon dioxide condenses on the tobacco. After the impregnation has been completed, the elevated pressure is reduced, thereby cooling the tobacco to the desired exit temperature. Cooling of the tobacco is due to both the expansion of the carbon dioxide gas and the evaporation of the condensed liquid carbon dioxide from the tobacco. The resulting carbon dioxide-containing tobacco is then subjected to conditions of temperature and pressure, preferably rapid heating at atmospheric pressure, which result in the expansion of the carbon dioxide impregnant and the consequent expansion of the tobacco to provide a tobacco of lower density and increased volume.

Tobacco impregnated according to the present invention may be expanded using less energy, e.g., a significantly lower temperature gas stream may be used at a comparable residence time, than tobacco impregnated under conditions where liquid carbon dioxide is used.

In addition, the present invention affords greater control of the chemical and flavor components, e.g., reducing sugars and alkaloids, in the final tobacco product by allowing expansion to be carried out over a greater temperature range than was practical in the past.

DETAILED DESCRIPTION OF THE INVENTION

The present invention relates broadly to a process for expanding tobacco employing a readily available, relatively inexpensive, non-combustible and non-toxic expansion agent. More particularly, the present invention relates to the production of an expanded tobacco product of substantially reduced density and increased filling power, produced by impregnating tobacco under pressure with saturated gaseous carbon dioxide and a controlled amount of condensed liquid carbon dioxide, rapidly releasing the pressure, and then causing the tobacco to expand. Expansion may be accomplished by subjecting the impregnated tobacco to heat, radiant energy or similar energy generating conditions which will cause the carbon dioxide impregnant to rapidly expand.

To carry out the process of the present invention, one may treat either whole cured tobacco leaf, tobacco in cut or chopped form, or selected parts of tobacco such as tobacco stems or possibly even reconstituted tobacco. In comminuted form, the tobacco to be impregnated preferably has a particle size of from about 6 mesh to about 100 mesh, more preferably the tobacco has a particle size not less than about 30 mesh. As used herein, mesh refers to United States standard sieve and those values reflect the ability of more than 95% of the particles of a given size to pass through a screen of a given mesh value.

As used herein, % moisture may be considered equivalent to oven-volatiles content (OV) since not more than about 0.9% of tobacco weight is volatiles other than water. Oven volatiles determination is a simple measurement of tobacco weight loss after exposure for 3 hours in a circulating air oven controlled at 212° F. The weight loss as a percentage of initial weight is oven-volatiles content.

BRIEF DESCRIPTION OF THE DRAWINGS

The above and other objects and advantages of the invention will be apparent upon consideration of the following detailed description and representative examples, taken in conjunction with the accompanying drawings, in which like run designations refer to like runs throughout, and in which.

Figure 1:
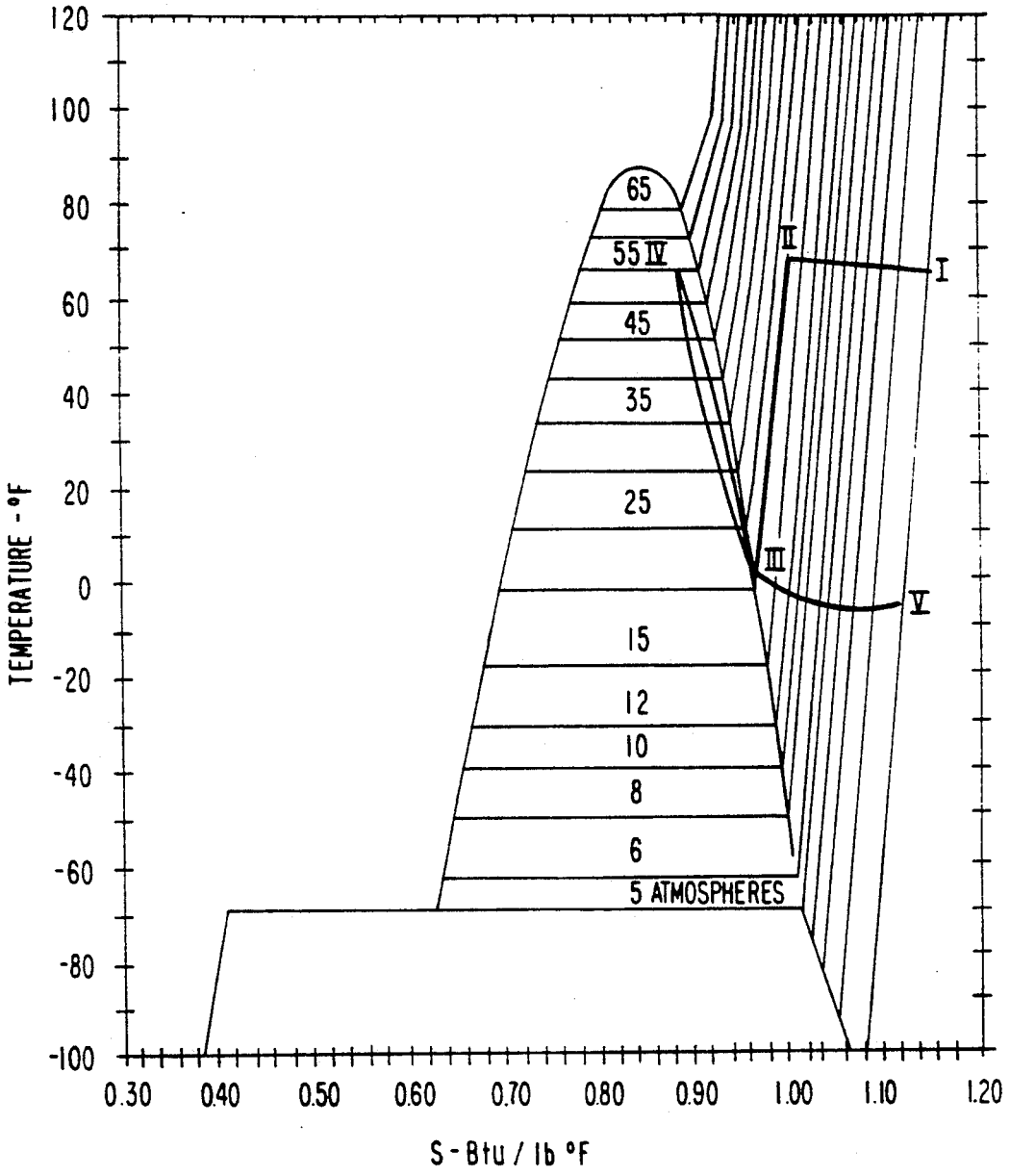
FIG. 1 is a standard temperature-entropy diagram for carbon dioxide.

Generally, the tobacco to be treated will have an OV content of at least about 12% and less than about 21%, although tobacco having a higher or lower OV content may be successfully impregnated according to the present invention. Preferably, the tobacco to be treated will have an OV content of about 13% to about 15%. Below about 12% OV, tobacco is too easily broken, resulting in a large amount of tobacco fines. Above about 21% OV, excessive amounts of pre-cooling are needed to achieve acceptable stability and a very low post-vent temperature is required, resulting in a brittle tobacco which is easily broken.

The tobacco to be expanded will generally be placed in a pressure vessel in such a manner that it can be suitably contacted by carbon dioxide. For example, a wire mesh belt or platform may be used to support the tobacco in the vessel.

For a batch impregnation process, the tobacco-containing pressure vessel is preferably purged with carbon dioxide gas, the purging operation generally taking from about 1 minute to about 4 minutes. The purging step may be eliminated without detriment to the final product. The benefits of purging are the removal of gases that may interfere with carbon dioxide recovery and the removal of foreign gases that may interfere with full penetration of the carbon dioxide.

The gaseous carbon dioxide which is employed in the process of this invention will generally be obtained from a supply tank where it is maintained in saturated liquid form at a pressure of from about 400 psig to about 1050 psig. The supply tank may be fed with recompressed gaseous carbon dioxide vented from the pressure vessel. Additional carbon dioxide may be obtained from a storage vessel where it is maintained in liquid form generally at a pressure of from about 215 psig to about 305 psig and temperatures of from about −20° F. to about 0° F. The liquid carbon dioxide from the storage vessel may be mixed with the recompressed gaseous carbon dioxide and stored in the supply tank. Alternatively, liquid carbon dioxide from the storage vessel may be preheated, for example, by suitable heating coils around the feed line, to a temperature of about 0° F. to about 84° F. and a pressure of about 300 psig to about 1000 psig before being introduced into the pressure vessel. After the carbon dioxide is introduced into the pressure vessel, the interior of the vessel, including the tobacco to be treated, will generally be at a temperature of from about 20° F. to about 80° F. and a pressure sufficient to maintain the carbon dioxide gas at or substantially at a saturated state.

Tobacco stability, i.e., the length of time the impregnated tobacco may be stored after depressurization before the final expansion step and still be satisfactorily expanded, is dependent on the initial tobacco OV content, i.e., pre-impregnation OV content, and the tobacco temperature after venting of the pressure vessel. Tobacco with a higher initial OV content requires a lower tobacco post-vent temperature than tobacco with a lower initial OV content to achieve the same degree of stability.

The effect of OV content on the stability of tobacco impregnated with carbon dioxide gas at 250 psia and −18° C. was determined by placing a weighed sample of bright tobacco, typically about 60 g to about 70 g, in a 300 cc pressure vessel. The vessel was then immersed in a temperature controlled bath set at −18° C. After the vessel reached thermal equilibrium with the bath, the vessel was purged with carbon dioxide gas. The vessel was then pressured to about 250 psia. Gas phase impregnation was assured by maintaining the carbon dioxide pressure at least 20 psi to 30 psi below the carbon dioxide saturation pressure at −18° C. After allowing the tobacco to soak at pressure for about 15 minutes to about 60 minutes the vessel pressure was rapidly decreased to atmospheric pressure in about 3 seconds to about 4 seconds by venting to atmosphere. The vent valve was immediately closed and the tobacco remained in the pressure vessel immersed in the temperature controlled bath at −18° C. for about 1 hour. After about 1 hour, the vessel temperature was increased to about 25° C. over about two hours in order to liberate the carbon dioxide remaining in the tobacco. The vessel pressure and temperature were continually monitored using an IBM compatible computer with LABTECH version 4 data acquisition software from Laboratories Technologies Corp. The amount of carbon dioxide evolved by the tobacco over time at a constant temperature, can be calculated based on the vessel pressure over time.

Figure 3:
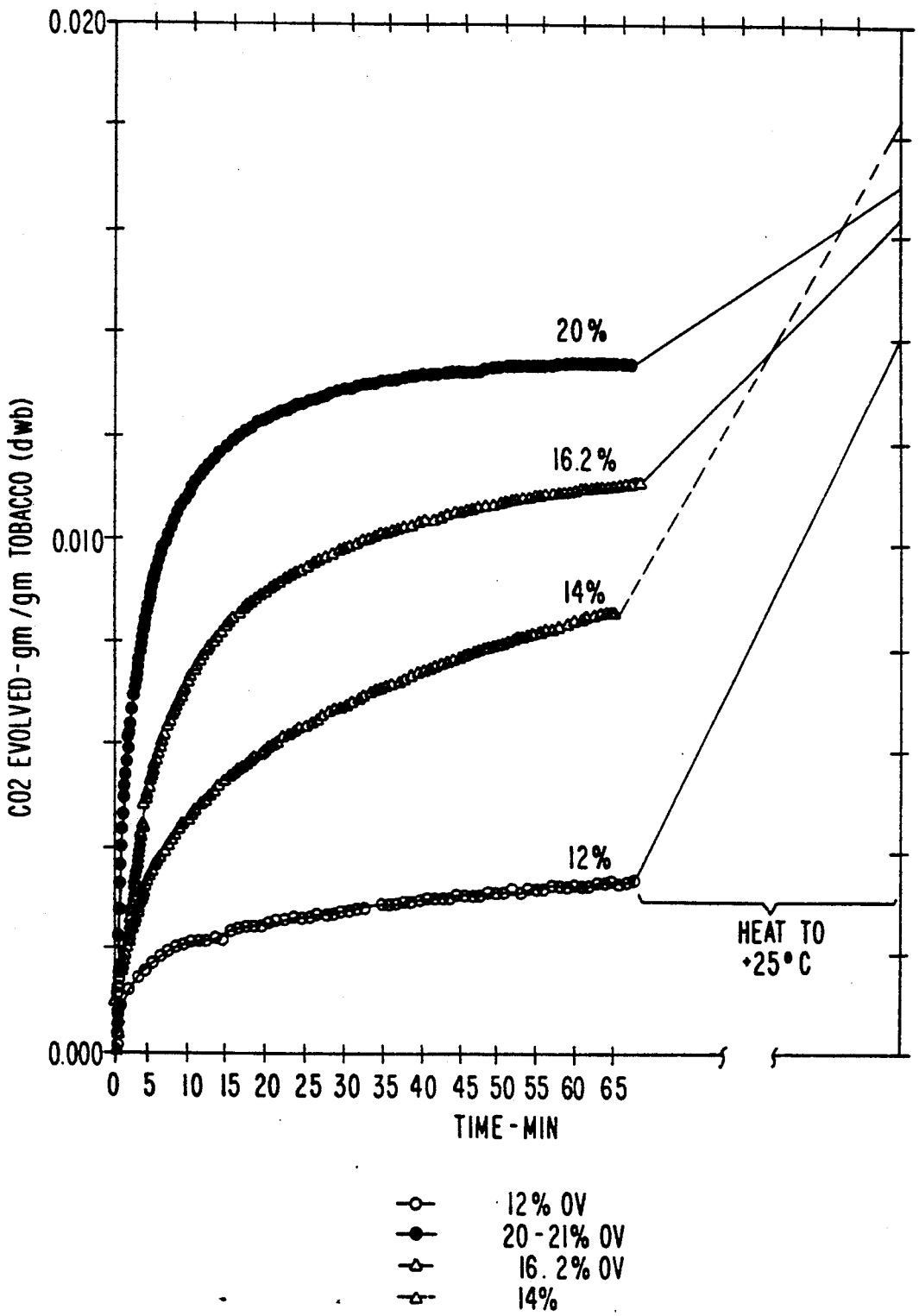
FIG. 3 is a plot of weight percent carbon dioxide evolved from tobacco impregnated at 250 psia and −18° C. versus post-impregnation time for tobacco with an OV content of about 12%, 14%, 16.2%, and 20%.

FIG. 3 compares the stability of about 12%, 14%, 16.2% and 20% OV bright tobacco impregnated with carbon dioxide gas at 250 psia at −18° C. as described above. Tobacco with an OV content of about 20% lost about 71% of its carbon dioxide pickup after 15 minutes at −18° C., while tobacco with an OV content of about 12% lost only about 25% of its carbon dioxide pickup after 60 minutes. The total amount of carbon dioxide evolved after increasing the vessel temperature to 25° C. is an indication of the total carbon dioxide pickup. This data indicates that, for impregnations at comparable pressures and temperatures, as tobacco OV content increases, tobacco stability decreases.

Figure 4:
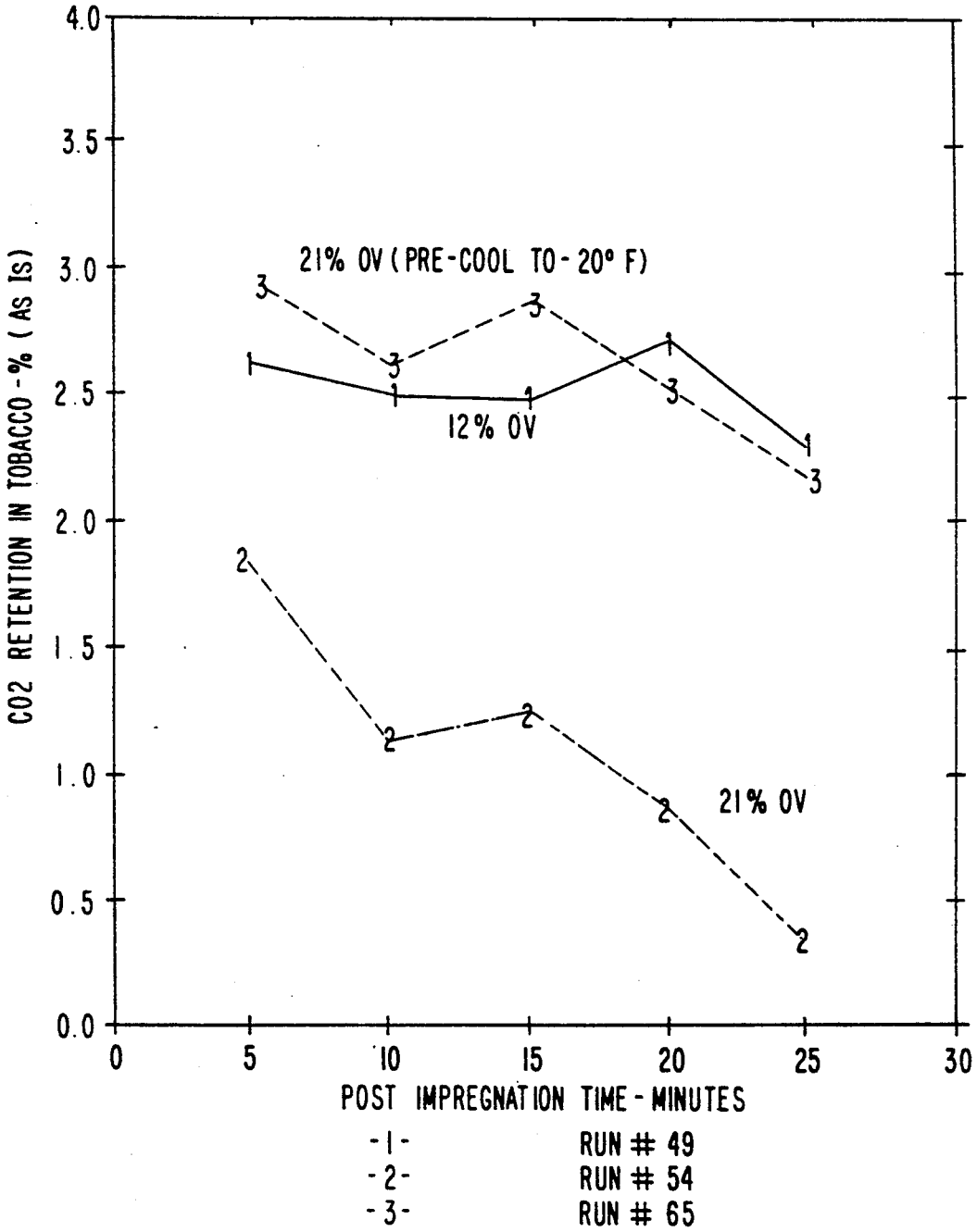
FIG. 4 is a plot of weight percent carbon dioxide retained in the tobacco versus post-vent time for three different OV tobaccos.
Figure 5:
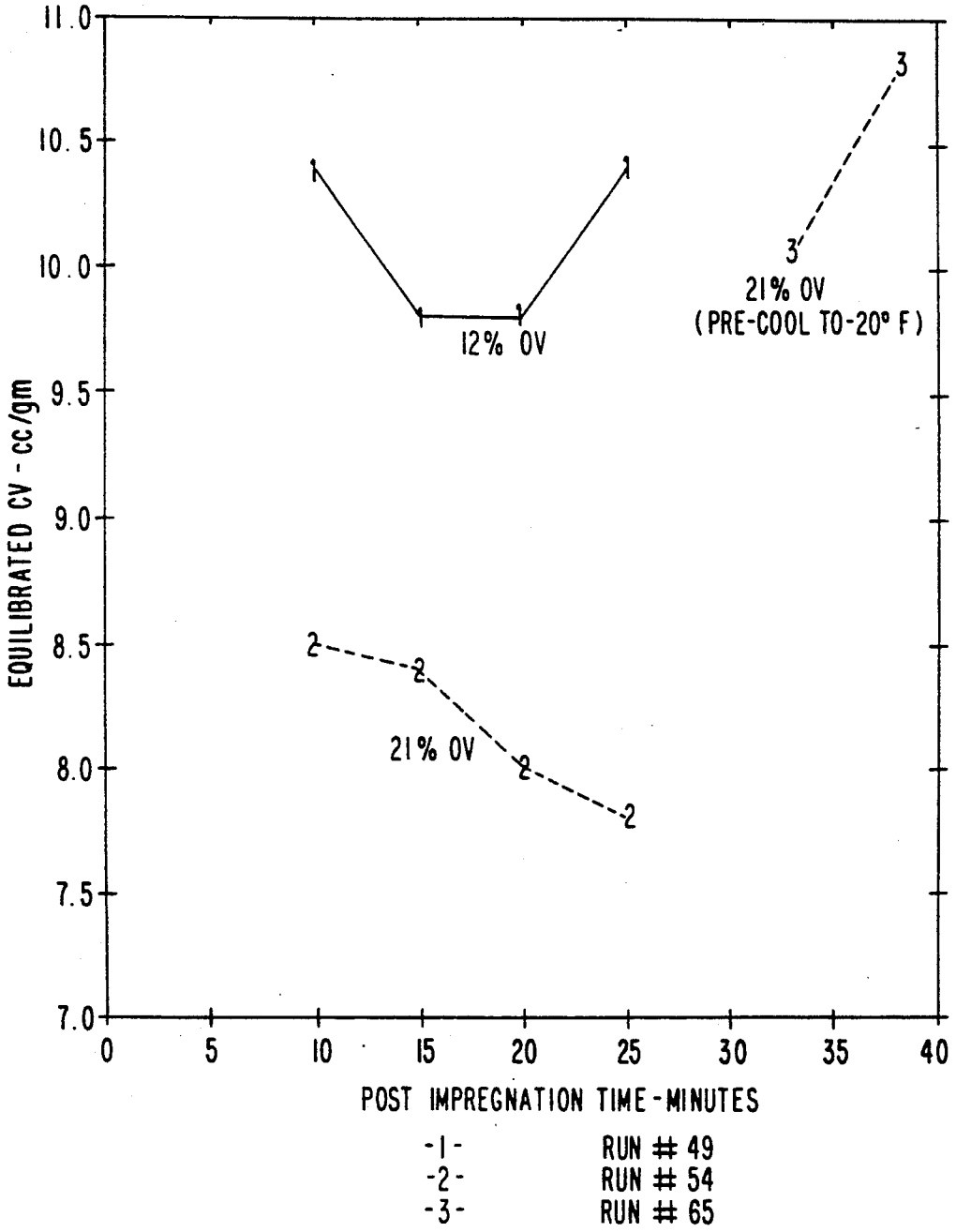
FIG. 5 is a plot of expanded tobacco equilibrium CV versus hold-time before expansion for tobacco with an OV content of about 12% and about 21%.
Figure 6:
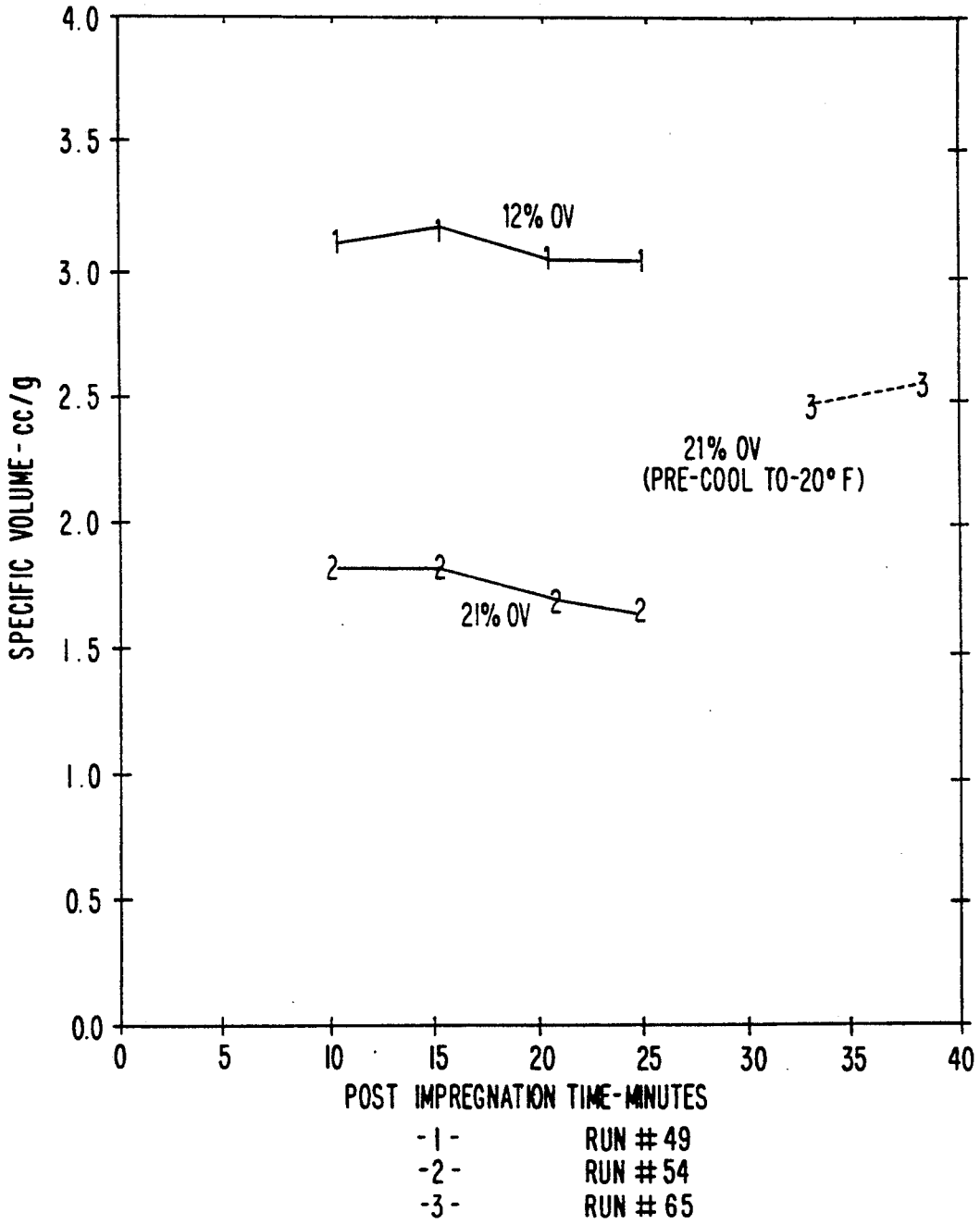
FIG. 6 is a plot of expanded tobacco specific volume versus hold-time before expansion for tobacco with an OV content of about 12% and about 21%.

In order to achieve sufficient tobacco stability, it is preferred that the tobacco temperature be approximately about 10° F. to about 10° F. after venting of the pressure vessel when the tobacco to be expanded has an initial OV content of about 15%. Tobacco with an initial OV content greater than about 15% should have a post-vent temperature lower than about 0° F. to about 10° F. and tobacco with an initial OV content less than 15% may be maintained at a temperature greater than about 0° F. to about 10° F. in order to achieve a comparable degree of stability. For example, FIG. 4 illustrates the effect of tobacco post-vent temperature on tobacco stability at various OV contents. FIG. 4 shows that tobacco with a higher OV content, about 21%, requires a lower post-vent temperature, about −35° F., in order to achieve a similar level of carbon dioxide retention over time as compared to a tobacco with a lower OV content, about 12%, with a post-vent temperature of about 0° F. to about 10° F. FIGS. 5 and 6, respectively, show the effect of tobacco OV content and post-vent temperature on equilibrated CV and specific volume of tobacco expanded after being held at its indicated post-vent temperature for the indicated time.

FIGS. 4, 5, and 6 are based on data from Runs 49, 54, and 65. In each of these runs, bright tobacco was placed in a pressure vessel with a total volume of 3.4 cubic feet, 2.4 cubic feet of which was occupied by the tobacco. In Runs 54 and 65, approximately 22 lbs. of 20% OV tobacco was placed in the pressure vessel. This tobacco was pre-cooled by flowing carbon dioxide gas through the vessel at about 421 psig and at about 153 psig for Runs 54 and 65, respectively, for about 4 to 5 minutes prior to pressurization to about 800 psig with carbon dioxide gas. In Run 49, approximately 13.5 pounds of tobacco at about 12.6% OV was placed in the pressure Vessel which was then pressurized to about 800 psig with carbon dioxide gas without an intermediate cooling step. The mass of carbon dioxide in the vessel at 800 psig, the mass of tobacco loaded into the vessel at the lower packing density of 12.6% OV tobacco and the lower heat capacity of the tobacco at 12.6% OV were such that the amount of carbon dioxide condensed on the tobacco required to achieve the final post-vent temperature of about 0° F. to 10° F. was negligible for Run 49.

Impregnation pressure, mass ratio of carbon dioxide to tobacco, and heat capacity of tobacco can be manipulated in such a manner that under specific circumstances, the amount of cooling required from the evaporation of condensed carbon dioxide is minimal relative to the cooling provided by the expansion of carbon dioxide gas upon depressurization.

In each of Runs 49, 54, and 65, after reaching the impregnation pressure of about 800 psig, the system pressure was held at about 800 psig for about 5 minutes before the vessel was rapidly depressurized to atmospheric pressure in approximately 90 seconds. The mass of carbon dioxide condensed per lb. of tobacco during pressurization after cooling was calculated for Runs 54 and 65 and is reported below. The impregnated tobacco was held at its post-vent temperature under a dry atmosphere until it was expanded in a 3-inch diameter expansion tower by contact with steam set at the indicated temperature and at a velocity of about 135 ft/sec for less than about 5 seconds.

TABLE 1

| Run | 49 | 54 | 65 |
|---|---|---|---|
| Feed OV % | 12.6 | 20.5 | 20.4 |
| Tobacco Wt. (lbs.) | 13.5 | 22.5 | 21.25 |
| $CO_2$ flow-thru cooling press. (psig) | none | 421 | 153 |
| Impreg. press (psig) | 800 | 800 | 772 |
| Pre-cool temp (°F.) | N/A | 10 | −20 |
| Post-vent temp. (°F.) | 0–10 | 10–20 | −35 |
| Expansion Tower gas temp (°F.) | 475 | 575 | 575 |
| Eq CV (cc/g) | 10.4 | 8.5 | 10.0 |
| SV (cc/g) | 3.1 | 1.8 | 2.5 |
| Calculated $CO_2$ condensed (lb./lb. tob.) | negligible | 0.19 | 0.58 |

The degree of tobacco stability required, and hence, the desired tobacco post-vent temperature, is dependent on many factors including the length of time after depressurization and before expansion of the tobacco. Therefore, the selection of a desired post-vent temperature should be made in light of the degree of stability required.

The desired tobacco post-vent temperature may be obtained by any suitable means including pre-cooling of the tobacco before introducing it to the pressure vessel, in-situ cooling of the tobacco in the pressure vessel by purging with cold carbon dioxide or other suitable means, or vacuum cooling in situ augmented by flow through of carbon dioxide gas. Vacuum cooling has the advantage of reducing the tobacco OV content without thermal degradation of the tobacco. Vacuum cooling also removes non-condensible gases from the vessel, thereby allowing the purging step to be eliminated. Vacuum cooling can be effectively and practically used to reduce the tobacco temperature to as low as about 30° F. It is preferred that the tobacco is cooled in situ in the pressure vessel.

The amount of pre-cooling or in-situ cooling required to achieve the desired tobacco post-vent temperature is dependent on the amount of cooling provided by the expansion of the carbon dioxide gas during depressurization. The amount of tobacco cooling due to the expansion of the carbon dioxide gas is a function of the ratio of the mass of the carbon dioxide gas to the mass of tobacco, the heat capacity of the tobacco, the final impregnation pressure, and the system temperature. Therefore, for a given impregnation, when the tobacco feed and the system pressure, temperature and volume are fixed, control of the final post-vent temperature of the tobacco may be achieved by controlling the amount of carbon dioxide permitted to condense on the tobacco. The amount of tobacco cooling due to evaporation of the condensed carbon dioxide from the tobacco is a function of the ratio of the mass of condensed carbon dioxide to the mass of tobacco, the heat capacity of the tobacco, and the temperature or pressure of the system.

Figure 13:
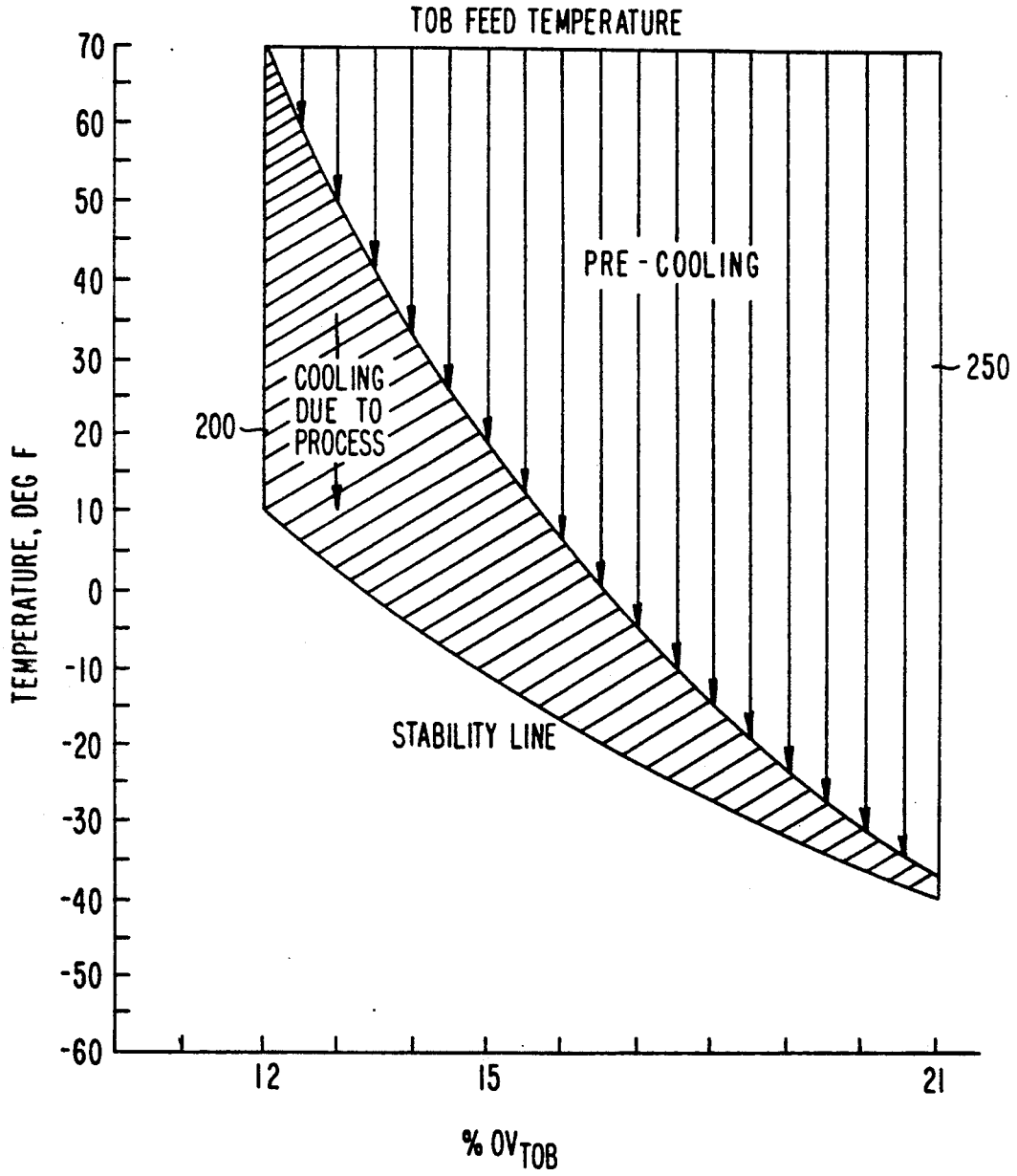
FIG. 13 is a plot of tobacco temperature versus tobacco OV showing the amount of pre-cooling required to achieve adequate stability (e.g., about 1 hour post-vent hold before expansion) for tobacco impregnated at 800 psig.

The required tobacco stability is determined by the specific design of the impregnation and expansion processes used. FIG. 13 illustrates the tobacco post-vent temperature required to achieve the desired tobacco stability as a function of OV for a particular process design. The lower shaded area 200 illustrates the amount of cooling contributed by carbon dioxide gas expansion and the upper area 250 illustrates the amount of additional cooling required by carbon dioxide liquid evaporation as a function of tobacco OV to provide the required stability. For this example, adequate tobacco stability is achieved when the tobacco temperature is at or below the temperature shown by the "stability" line. The process variables which determine the tobacco post-vent temperature include the variables discussed previously and other variables including, but not limited to, vessel temperature, vessel mass, vessel volume, vessel configuration, flow geometry, equipment orientation, heat transfer rate to the vessel walls, and process designed retention time between impregnation and expansion.

For the 800 psig process illustrated in FIG. 13, with a post-vent hold time of about 1 hour, no pre-cooling is required for 12% OV tobacco to achieve the required stability, whereas 21% OV tobacco requires sufficient pre-cooling to achieve a post-vent temperature of about −35° F.

The desired tobacco post-vent temperature of the present invention, from about −35° F. to about 20° F., is significantly higher than the post-vent temperature—about −110° F.—when liquid carbon dioxide is used as the impregnant. This higher tobacco post-vent temperature and lower tobacco OV allow the expansion step to be conducted at a significantly lower temperature, resulting in an expanded tobacco with less toasting and less loss of flavor. In addition, less energy is required to expand the tobacco. Moreover, because very little, if any, solid carbon dioxide is formed, handling of the impregnated tobacco is simplified. Unlike tobacco impregnated with only liquid carbon dioxide, tobacco impregnated according to the present invention does not tend to form clumps which must be mechanically broken. Thus, a greater usable-tobacco yield is achieved because the clumpbreaking step which results in tobacco fines too small for use in cigarettes is eliminated.

Moreover, about 21% OV tobacco at about −35° F. to about 12% OV tobacco at about 20° F., unlike any OV tobacco at about −110° F., is not brittle and, therefore, is handled with minimum degradation. This property results in a greater yield of usable tobacco because less tobacco is mechanically broken during normal handling, e.g., during unloading of the pressure vessel or transfer from the pressure vessel to the expansion zone.

Chemical changes during expansion of the impregnated tobacco, e.g., loss of reducing sugars and alkaloids upon heating, can be reduced by increasing the exit tobacco OV, i.e., the tobacco OV content immediately after expansion, to about 6% OV or higher. This can be accomplished by reducing the temperature of the expansion step. Normally, an increase in tobacco exit OV is coupled with a decrease in the amount of expansion achieved. The decrease in the amount of expansion depends strongly on the starting feed OV content of the tobacco. As the tobacco feed OV is reduced to approximately 13%, minimal reduction in the degree of expansion is observed even at a tobacco moisture content of about 6% or more exiting the expansion device. Therefore, if the feed OV and the expansion temperature are reduced, surprisingly good expansion can be attained while chemical changes are minimized. This is shown in FIGS. 7, 8 and 9.

Figure 7:
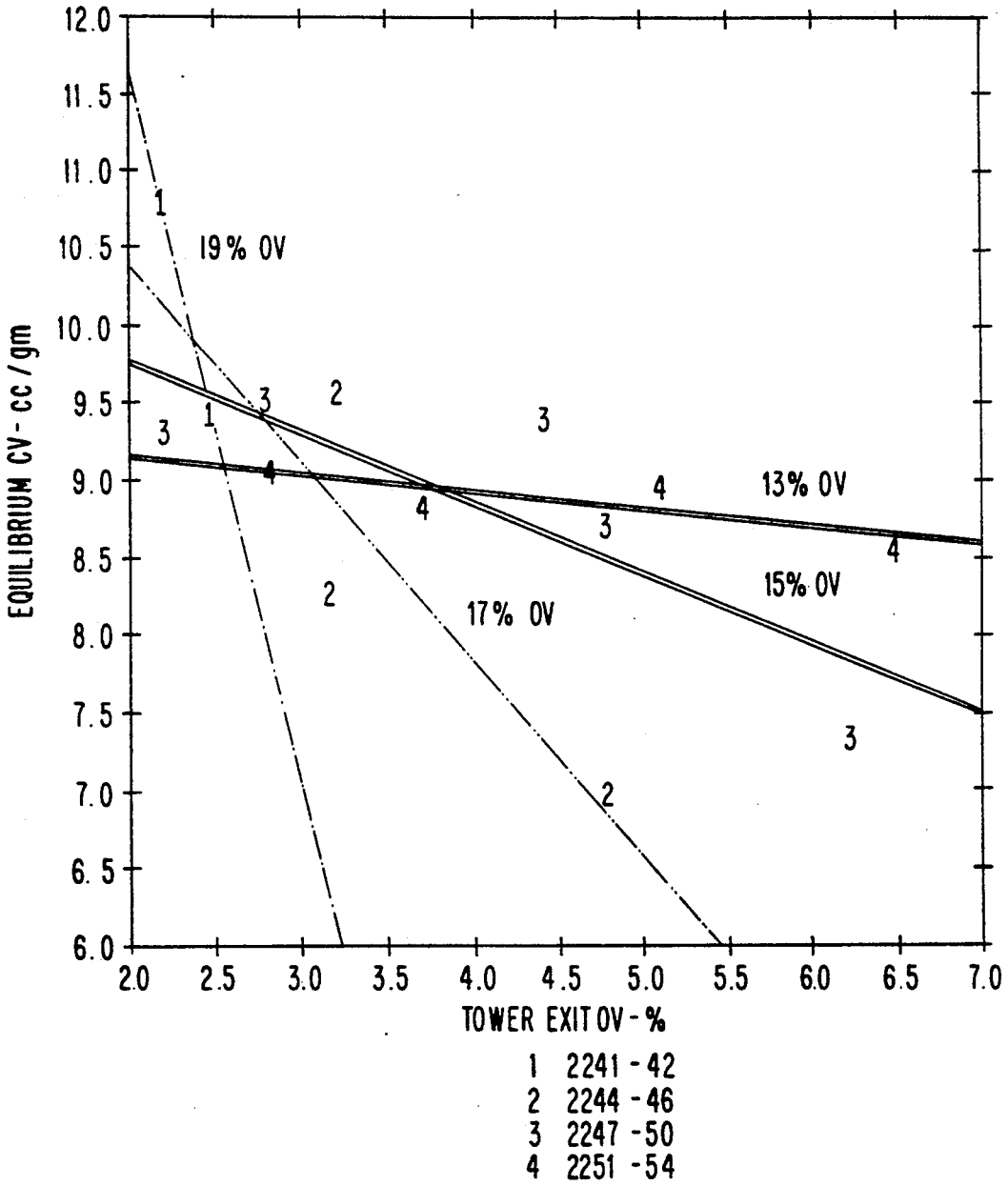
FIG. 7 is a plot of expanded tobacco equilibrium CV versus expansion tower exit OV content.
Figure 8:
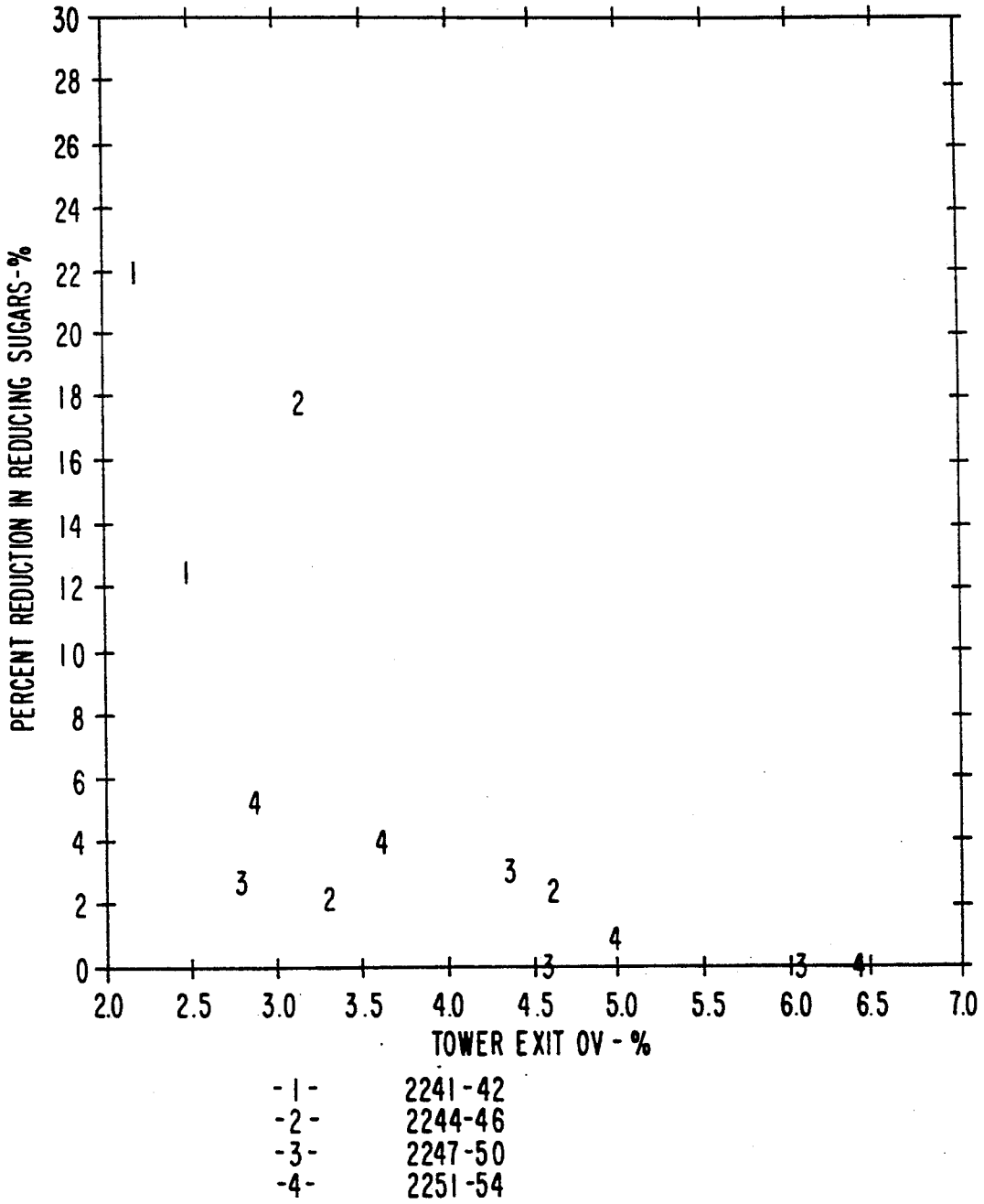
FIG. 8 is a plot of percent reduction in tobacco reducing sugars versus expansion tower exit OV content.
Figure 9:
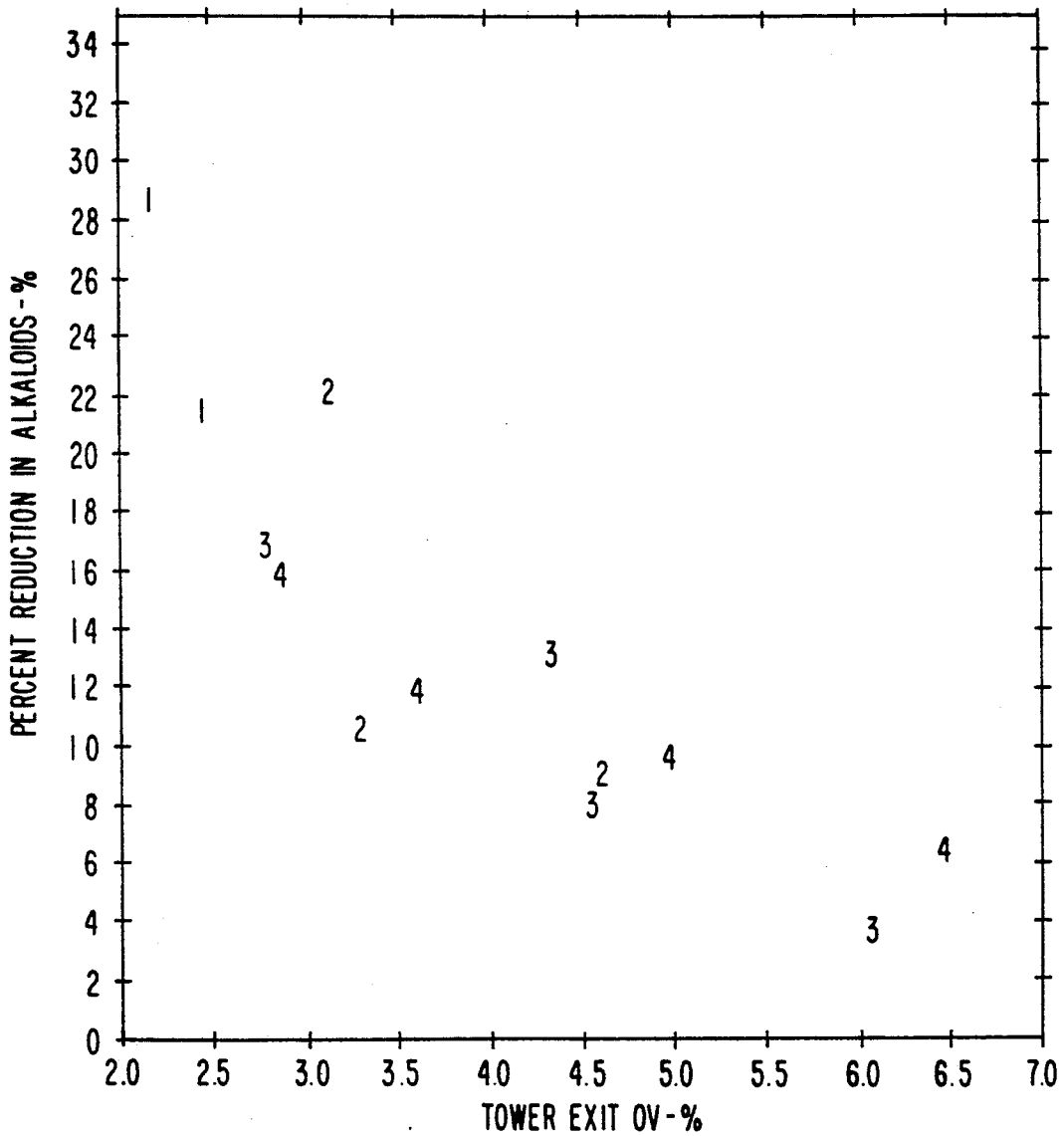
FIG. 9 is a plot of percent reduction in tobacco alkaloids versus expansion tower exit OV content.

FIGS. 7, 8, and 9 are based on data from Runs 2241 thru 2242 and 2244 thru 2254. This data is tabulated in Table 2. In each of these runs a measured amount of bright tobacco was placed in a pressure vessel similar to the vessel described in Example 1.

TABLE 2

| Run No. | 2241 | 2242 | 2244–46(3rd) | 2245(2nd) | 2246(1st) | 2247–48(1st) | 2248(2nd) | 2249–50(1st) |
|---|---|---|---|---|---|---|---|---|
| Tobacco wt (lb.) | 100 | 100 | 325 | 325 | 325 | 240 | 240 | 240 |
| $CO_2$ condensed (lb./lb.) (calculated) | Not applicable | Not applicable | 0.36 | 0.36 | 0.36 | 0.29 | 0.29 | 0.29 |
| Tower Temp (°F.) | 625 | 675 | 500 | 550 | 600 | 400 | 450 | 500 |
| Feed: | | | | | | | | |
| As Is OV | 18.8 | 18.9 | 17.0 | 17.2 | 17.5 | 14.30 | 14.2 | 15.2 |
| Eq OV | 12.2 | 12.1 | 12.2 | 12.1 | 12.0 | 11.6 | 11.8 | 11.8 |
| Eq CV (cc/g) | 4.5 | 4.6 | 4.8 | 4.9 | 4.9 | 5.2 | 5.3 | 5.3 |
| SV (cc/g) | 0.8 | 0.9 | 0.8 | 0.8 | 0.8 | 0.8 | 0.8 | 0.8 |
| Tower: | | | | | | | | |
| As Is OV | 2.5 | 2.2 | 4.6 | 3.3 | 3.1 | 6.1 | 4.6 | 4.4 |
| Eq OV | 11.5 | 11.2 | 11.9 | 11.8 | 11.6 | 12.0 | 11.6 | 11.5 |

TABLE 2-continued

| | | | | | | | | |
|---|---|---|---|---|---|---|---|---|
| Eq CV (CC/g) | 9.5 | 10.8 | 7.1 | 8.2 | 9.5 | 7.4 | 8.7 | 9.4 |
| SV (cc/g) | 3.0 | 3.1 | 1.8 | 2.3 | 2.8 | 2.2 | 2.6 | 2.9 |
| Feed: | | | | | | | | |
| Alkaloids* | 2.71 | 2.71 | 2.71 | 2.71 | 2.71 | 2.71 | 2.71 | 2.71 |
| Reducing Sugars* | 13.6 | 13.6 | 13.6 | 13.6 | 13.6 | 13.6 | 13.6 | 13.6 |
| Tower Exit: | | | | | | | | |
| Alkaloids* | 2.12 | 1.94 | 2.47 | 2.42 | 2.12 | 2.61 | 2.49 | 2.36 |
| % Reduction | 21.8 | 28.4 | 8.9 | 10.7 | 21.8 | 3.7 | 8.1 | 12.9 |
| Reducing Sugars* | 11.9 | 10.6 | 13.3 | 13.3 | 11.2 | 13.6 | 13.6 | 13.2 |
| % Reduction | 12.5 | 22.0 | 2.2 | 2.2 | 17.6 | 0 | 0 | 2.9 |

| Run No. | 2250(2nd) | 2251-52(1st) | 2252(2nd) | 2253-54(1st) | 2254(2nd) |
|---|---|---|---|---|---|
| Tobacco wt (lb.) | 240 | 210 | 210 | 210 | 210 |
| $CO_2$ condensed (lb./lb.) (calculated) | 0.29 | 0.25 | 0.25 | 0.25 | 0.25 |
| Tower Temp (°F.) | 550 | 375 | 425 | 475 | 525 |
| Feed: | | | | | |
| As Is OV | 15.0 | 12.9 | 13.0 | 12.8 | 12.9 |
| Eq OV | 11.9 | 12.0 | 11.6 | 11.8 | 12.0 |
| Eq CV (cc/g) | 5.3 | 5.4 | 5.4 | 5.3 | 5.4 |
| SV (cc/g) | 0.8 | 0.8 | 0.8 | 0.8 | 0.8 |
| Tower: | | | | | |
| As Is OV | 2.8 | 6.5 | 5.0 | 3.60 | 2.9 |
| Eq OV | 11.4 | 12.2 | 12.1 | 11.8 | 11.7 |
| Eq CV (CC/g) | 9.4 | 8.6 | 8.9 | 8.9 | 9.1 |
| SV (cc/g) | 3.0 | 2.6 | 2.8 | 3.1 | 3.2 |
| Feed: | | | | | |
| Alkaloids* | 2.71 | 2.71 | 2.71 | 2.71 | 2.71 |
| Reducing Sugars* | 13.6 | 13.6 | 13.6 | 13.6 | 13.6 |
| Tower Exit: | | | | | |
| Alkaloids* | 2.26 | 2.54 | 2.45 | 2.39 | 2.28 |
| % Reduction | 16.6 | 6.3 | 9.6 | 11.8 | 15.9 |
| Reducing Sugars* | 13.2 | 13.6 | 13.5 | 13.1 | 12.9 |
| % Reduction | 2.9 | 0 | 0.7 | 3.7 | 5.1 |

*weight %, dry weight basis

Liquid carbon dioxide at 430 psig was used to impregnate the tobacco in Runs 2241 and 2242. The tobacco was allowed to soak in the liquid carbon dioxide for about 60 seconds before the excess liquid was drained. The vessel was then rapidly depressurized to atmospheric pressure, forming solid carbon dioxide in situ. The impregnated tobacco was then removed from the vessel and any clumps which may have formed were broken. The tobacco was then expanded in an 8-inch expansion tower by contact with a 75% steam/air mixture set at the indicated temperature and a velocity of about 85 ft/sec for less than about 4 seconds.

The nicotine alkaloids and reducing sugars content of the tobacco prior to and after expansion were measured using a Bran Luebbe (formerly Technicon) continuous flow analysis system. An aqueous acetic acid solution is used to extract the nicotine alkaloids and reducing sugars from the tobacco. The extract is first subjected to dialysis which removes major interferences of both determinations. Reducing sugars are determined by their reaction with p-hydroxybenzoic acid hydrazide in a basic medium at 85° C. to form a color. Nicotine alkaloids are determined by their reaction with cyanogen chloride, in the presence of aromatic amine. A decrease in the alkaloids or the reducing sugars content of the tobacco is indicative of a loss of or change in chemical and flavor components of the tobacco.

Runs 2244 thru 2254 were impregnated with gaseous carbon dioxide at 800 psig according to the method described in Example 1. In order to study the effect of expansion temperature, tobacco from a single impregnation was expanded at different temperatures. For example, 325 lbs. of tobacco were impregnated and then three samples, taken over the course of about 1 hour, were tested and expanded at 500° F., 550° F., and 600° F., representing Runs 2244, 2245, and 2246, respectively. In order to study the effect of OV content, batches of tobacco with OV contents of about 13%, 15%, 17%, and 19% were impregnated. The notation 1st, 2nd, or 3rd next to the run number indicates the order in which the tobacco was expanded from a particular impregnation. The impregnated tobacco was expanded in an 8-inch expansion tower by contact with a 75% steam/air mixture set at the indicated temperature and a velocity of about 85 ft/sec for less than about 4 seconds. The alkaloids and reducing sugars content of the tobacco were measured in the same manner as described above.

Figure 2:
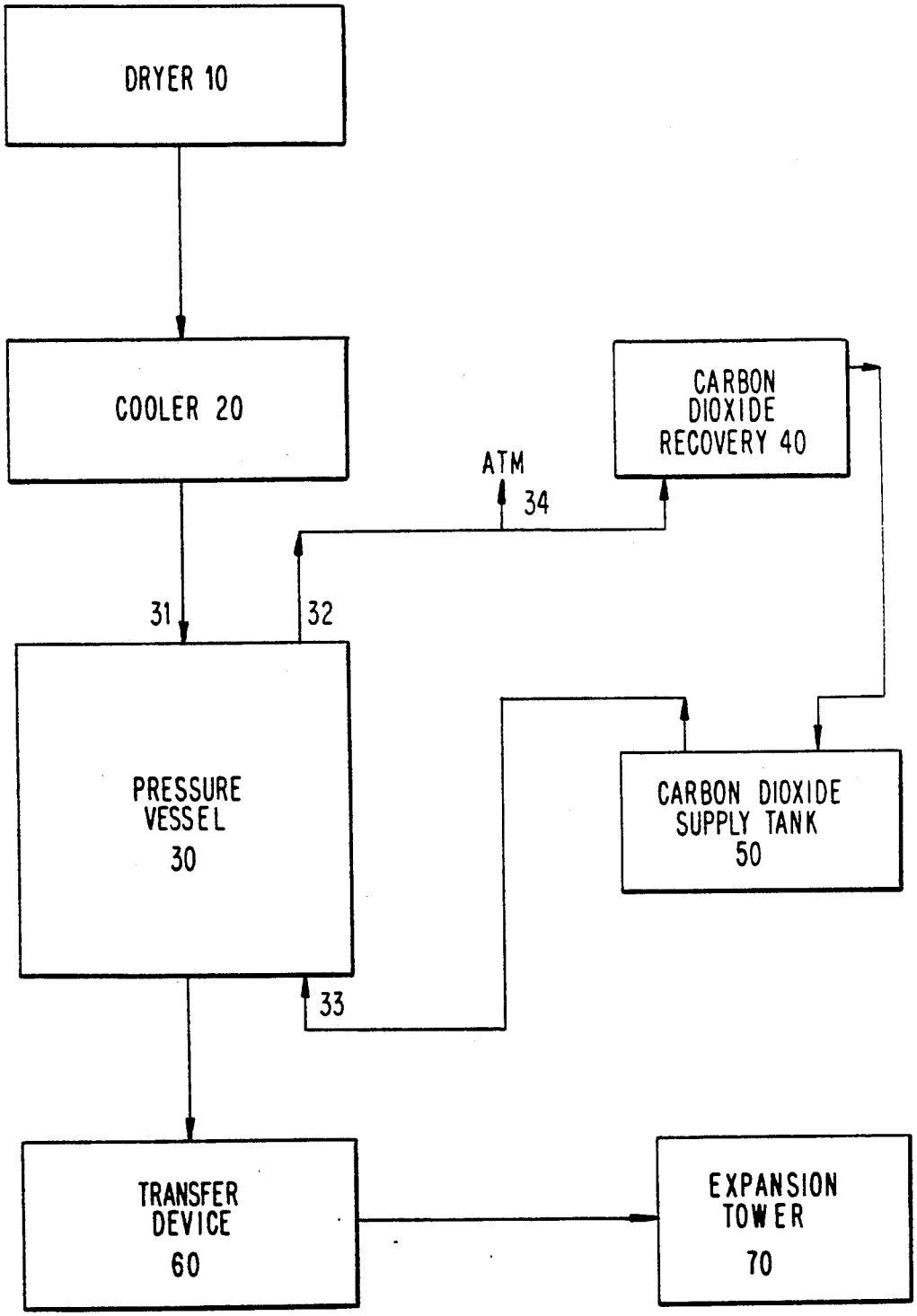
FIG. 2 is a simplified block diagram of a process for expanding tobacco incorporating one form of the present invention.

Referring to FIG. 2, tobacco to be treated is introduced to the dryer 10, where it is dried from about 19% to about 28% moisture (by weight) to from about 12% to about 21% moisture (by weight), preferably about 13% to about 15% moisture (by weight). Drying may be accomplished by any suitable means. This dried tobacco may be stored in bulk in a silo for subsequent impregnation and expansion or it may be fed directly to the pressure vessel 30 after suitable temperature adjustment.

Optionally, a measured amount of dried tobacco is metered by a weighbelt and fed onto a conveyor belt within the tobacco cooling unit 20 for treatment prior to impregnation. The tobacco is cooled within the tobacco cooling unit 20 by any conventional means including refrigeration, to less than about 20° F., preferably to less than about 0° F., before being fed to the pressure vessel 30.

The cooled tobacco is fed to the pressure vessel 30 through the tobacco inlet 31 where it is deposited. The pressure vessel 30 is then purged with gaseous carbon dioxide, to remove any air or other non-condensible gases from the vessel 30. It is desired that the purge be conducted in such a manner as not to significantly raise the temperature of the tobacco in the vessel 30. Preferably, the effluent of this purge step is treated in any suitable manner to recover the carbon dioxide for reuse or it may be vented to atmosphere through line 34.

Following the purge step, carbon dioxide gas is introduced to the pressure vessel 30 from the supply tank 50 where it is maintained at about 400 psig to about 1050 psig. When the inside pressure of the vessel 30 reaches from about 300 psig to about 500 psig, the carbon dioxide outlet 32 is opened allowing the carbon dioxide to flow through the tobacco bed cooling the tobacco to a substantially uniform temperature while maintaining the pressure of the vessel 30 at from about 300 psig to about 500 psig. After a substantially uniform tobacco temperature is reached, the carbon dioxide outlet 32 is closed and the pressure of the vessel 30 is increased to from about 700 psig to about 1000 psig, preferably about 800 psig, by the addition of carbon dioxide gas. Then the carbon dioxide inlet 33 is closed. At this point, the tobacco bed temperature is approximately at the carbon dioxide saturation temperature. While pressures as high as 1050 psig might be economically employed, and a pressure equal to the critical pressure of carbon dioxide, 1057 psig, would be acceptable, there is no known upper limit to the useful impregnation pressure range, other than that imposed by the capabilities of the equipment available and the effects of supercritical carbon dioxide on the tobacco.

During pressurization of the pressure vessel, it is preferred that a thermodynamic path is followed that allows a controlled amount of the saturated carbon dioxide gas to condense on the tobacco. FIG. 1 is a standard temperature (°F.) - entropy (Btu/lb°F.) diagram for carbon dioxide with line I–V drawn to illustrate one thermodynamic path in accord with the present invention. For example, tobacco at about 65° F. is placed in a pressure vessel (at I) and the vessel pressure is increased to about 300 psig (as shown by line I–II). The vessel is then cooled to about 0° F. by flow-thru cooling of carbon dioxide at about 300 psig (as shown by line II–III). Additional carbon dioxide gas is introduced to the vessel, raising the pressure to about 800 psig and the temperature to about 67° F. However, because the temperature of tobacco is below the saturation temperature of the carbon dioxide gas, a controlled amount of carbon dioxide gas will uniformly condense on the tobacco (as shown by line III–IV). After holding the system at about 800 psig for the desired length of time, the vessel is rapidly depressurized to atmospheric pressure resulting in a post-vent temperature of about −5° F. to about −10° F. (as shown by line IV–V).

In-situ cooling of the tobacco to about 10° F. prior to pressurization generally will allow an amount of the saturated carbon dioxide gas to condense. Condensation generally will result in a substantially uniform distribution of liquid carbon dioxide throughout the tobacco bed. Evaporation of this liquid carbon dioxide during the vent step will help cool the tobacco in a uniform manner. A uniform post-impregnation tobacco temperature results in a more uniform expanded tobacco.

Figure 10:
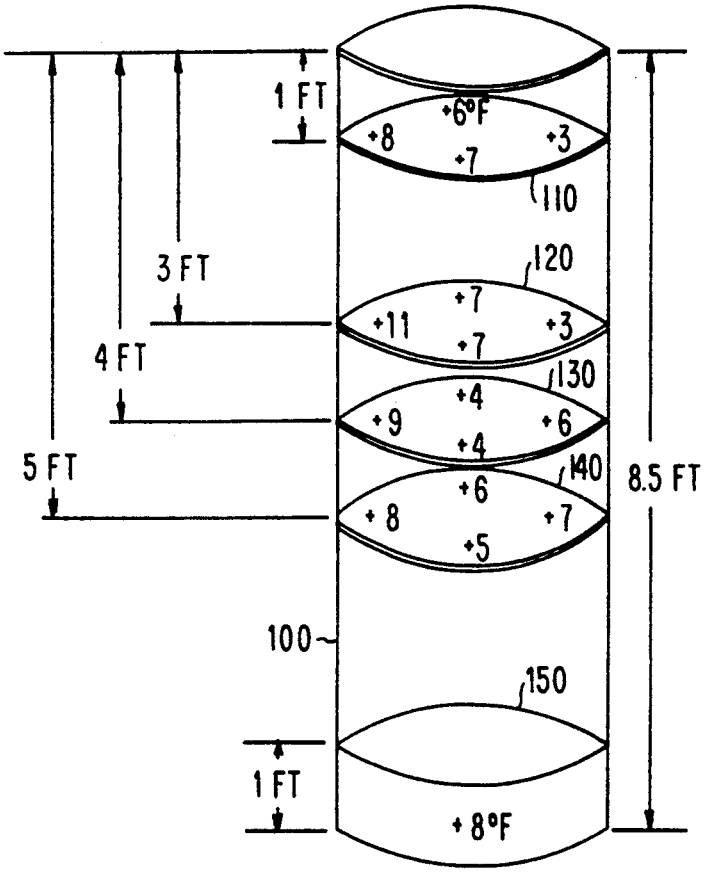
FIG. 10 is a schematic diagram of an impregnation vessel showing the tobacco temperature at various points throughout the tobacco bed after venting.

This uniform tobacco temperature is illustrated in FIG. 10, which is a schematic diagram of the impreqnation vessel 100 used in Run 28 showing the temperature, in °F., at various locations throughout the tobacco bed after venting. For example, the tobacco-bed temperature at cross-section 120, 3 feet from the top of vessel 100, was found to have temperatures of about 11° F., 7° F., 7° F., and 3° F. About 1800 lbs. of bright tobacco with an OV content of about 15% was placed in a 5 ft (i.d.)×8.5 ft (ht) pressure vessel. The vessel was then purged with carbon dioxide gas for about 30 seconds before pressurizing to about 350 psig with carbon dioxide gas. The tobacco bed was then cooled to about 10° F. by flow-thru cooling at 350 psig for about 12.5 minutes. The vessel pressure was then increased to about 800 psig and held for about 60 seconds before rapidly depressurizing in about 4.5 minutes. The temperature of the tobacco bed at various points was measured and found to be substantially uniform as shown in FIG. 10. It was calculated that about 0.26 lbs. of carbon dioxide condensed per lb. of tobacco.

Returning to FIG. 2, the tobacco in the pressure vessel 30 is maintained under carbon dioxide pressure at about 800 psig for from about 1 second to about 300 seconds, preferably about 60 seconds. It has been discovered that tobacco contact time with carbon dioxide gas, i.e., the length of time that the tobacco must be maintained in contact with the carbon dioxide gas in order to absorb a desired amount of carbon dioxide, is influenced strongly by the tobacco OV content and the impregnation pressure used. Tobacco with a higher initial OV content requires less contact time at a given pressure than tobacco with a lower initial OV content in order to achieve a comparable degree of impregnation particularly at lower pressures. At higher impregnation pressures, the effect of tobacco OV on contact time with the carbon dioxide gas is reduced. This is illustrated in Table 3.

After the tobacco has soaked sufficiently, the pressure vessel 30 is depressurized rapidly to atmospheric pressure in from about 1 second to about 300 seconds, depending on vessel size, by venting the carbon dioxide first to the carbon dioxide recovery unit 40 and then through line 34 to atmosphere. Carbon dioxide which has condensed on the tobacco is vaporized during this vent step, helping to cool the tobacco, resulting in a tobacco post-vent temperature of from about −35° F. to about 20° F.

Impregnated tobacco from the pressure vessel 30 may be expanded immediately by any suitable means, e.g., by feeding to the expansion tower 70. Alternatively, impregnated tobacco may be maintained for about 1 hour at its post-vent temperature in the tobacco transfer device 60 under a dry atmosphere, i.e., an atmosphere with a dewpoint below the post-vent temperature, for subsequent expansion. After expansion and, if desired, reordering, the tobacco may be used in the manufacture of tobacco products, including cigarettes.

TABLE 3

Effects Of Impregnation Pressure And Tobacco OV On Contact Time With $CO_2$

| Run | 20 | 14 | 21 | 59 | 49 | 33 | 32 | 35 | 30 | 27 |
|---|---|---|---|---|---|---|---|---|---|---|
| Initial Tob OV (%) | 12.2 | 11.7 | 11.8 | 12.3 | 12.6 | 16.7 | 16.4 | 16.9 | 16.5 | 16.0 |
| Impregnation Pressure (psig) | 471 | 462 | 465 | 802 | 800 | 430 | 430 | 430 | 460 | 450 |
| Contact Time at | 5 | 15 | 60 | 1 | 5 | 0.25 | 5 | 10 | 15 | 20 |

TABLE 3-continued

| Effects Of Impregnation Pressure And Tobacco OV On Contact Time With $CO_2$ | | | | | | | | | | |
|---|---|---|---|---|---|---|---|---|---|---|
| Run | 20 | 14 | 21 | 59 | 49 | 33 | 32 | 35 | 30 | 27 |
| Impregnation Press. (minutes) | | | | | | | | | | |
| Tower Exit: | | | | | | | | | | |
| Eq CV (cc/g) | 7.5 | 8.7 | 10.1 | 9.8 | 10.4 | 8.5 | 9.3 | 10.5 | 11.1 | 10.5 |
| SV (cc/g) | 1.8 | 2.1 | 2.8 | 3.1 | 3.1 | 2.1 | 2.6 | 3.4 | 3.1 | 2.9 |
| Control* | | | | | | | | | | |
| Eq CV (cc/g) | 5.3 | 5.4 | 5.2 | 5.6 | 5.7 | 5.5 | 5.5 | 5.7 | 5.5 | 5.5 |
| SV (cc/g) | 0.8 | 0.8 | 0.8 | 0.8 | 0.8 | 0.8 | 0.8 | 0.8 | 0.8 | 0.8 |

*CV and SV of feed tobacco

The following examples are illustrative:

EXAMPLE 1

A 240 pound sample of bright tobacco filler with a 15% OV content was cooled to about 20° F. and then placed in a pressure vessel approximately 2 feet in diameter and approximately 8 feet in height. The vessel was then pressured to about 300 psig with carbon dioxide gas. The tobacco was then cooled, while maintaining the vessel pressure at about 300 psig, to about 0° F. by flushing with carbon dioxide gas near saturated conditions for about 5 minutes prior to pressurizing to about 800 psig with carbon dioxide gas. The vessel pressure was maintained at about 800 psig for about 60 seconds. The vessel pressure was decreased to atmospheric pressure by venting in about 300 seconds, after which the tobacco temperature was found to be about 0° F. Based on the tobacco temperature, the system pressure, temperature, and volume, and the tobacco post-vent temperature, it was calculated that approximately 0.29 lbs. of carbon dioxide condensed per lb. of tobacco.

The impregnated sample had a weight gain of about 2% which is attributable to the carbon dioxide impregnation. The impregnated tobacco was then, over a one hour period, exposed to heating in an 8-inch diameter expansion tower by contact with a 75% steam/air mixture at about 550° F. and a velocity of about 85 ft/sec for less than about 2 seconds. The product exiting the expansion tower had an OV content of about 2.8%. The product was equilibrated at standard conditions of 75° F. and 60% RH for about 24 hours. The filling power of the equilibrated product was measured by the standardized cylinder volume (CV) test. This gave a CV value of 9.4 cc/g at an equilibrium moisture content of 11.4%. An unexpanded control was found to have a cylinder volume of 5.3 cc/g at an equilibrium moisture content of 12.2%. The sample after processing, therefore, had a 77% increase in filling power as measured by the CV method.

Figure 11:
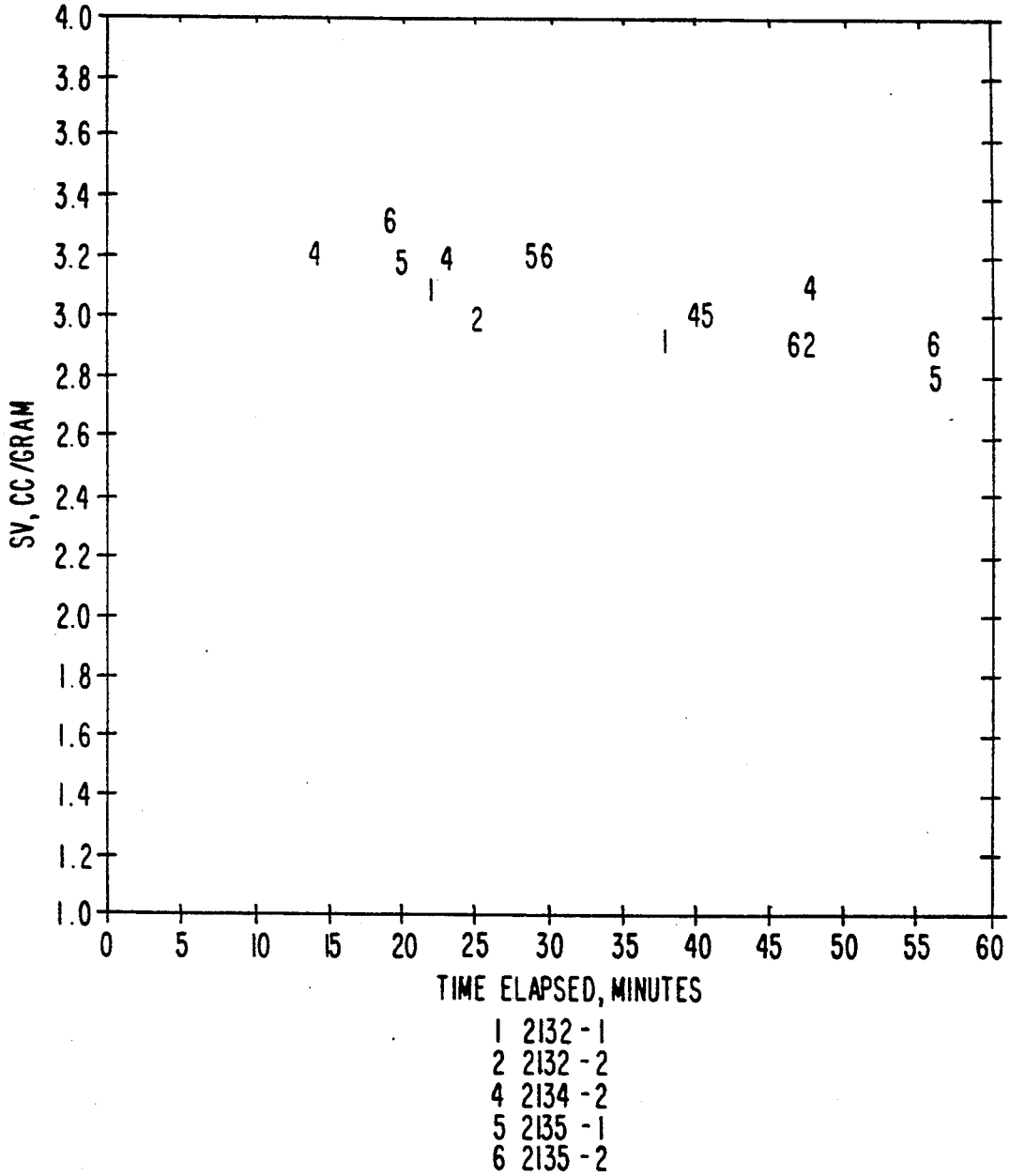
FIG. 11 is a plot of expanded tobacco specific volume versus hold-time after impregnation prior to expansion.
Figure 12:
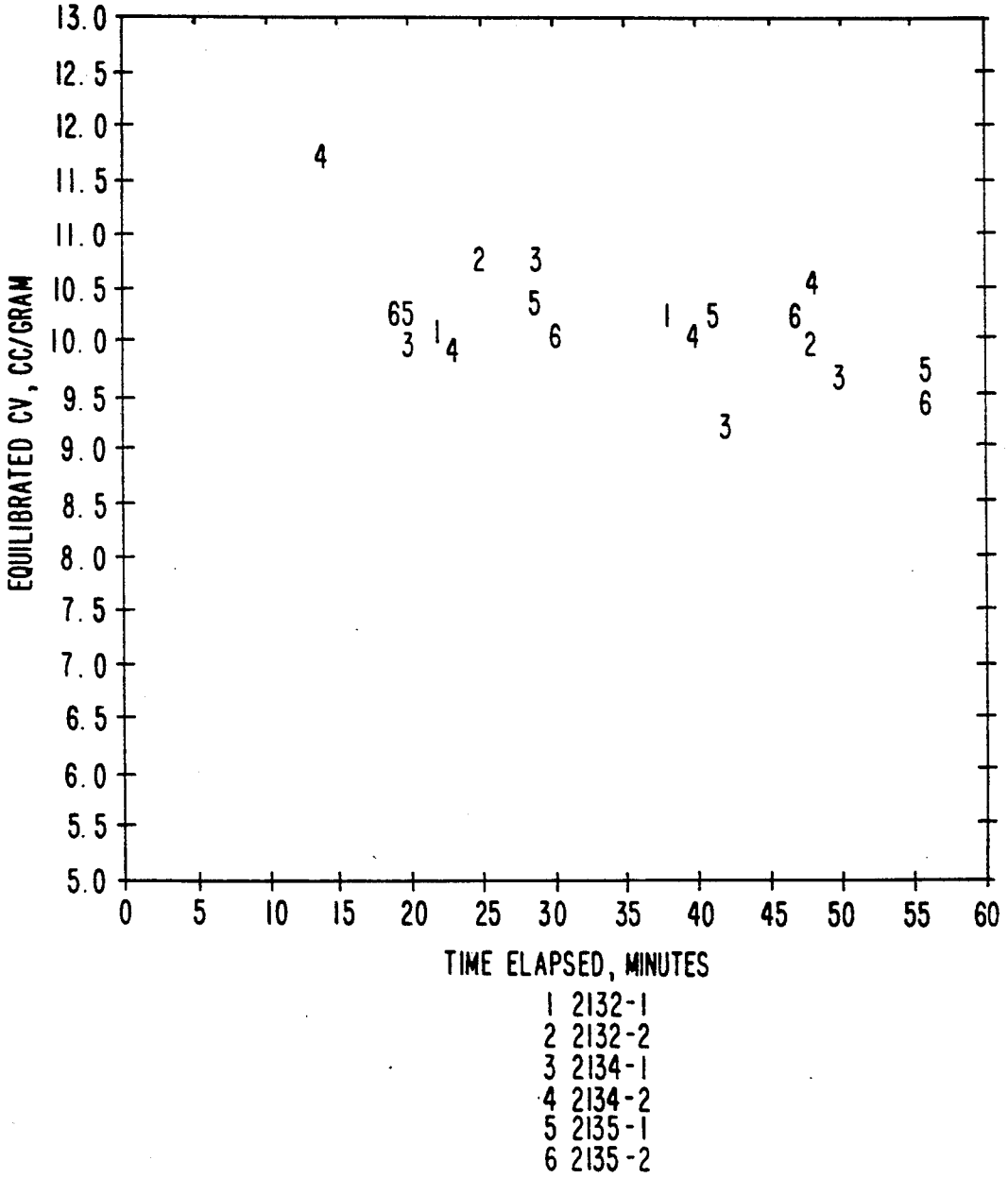
FIG. 12 is a plot of expanded tobacco equilibrium CV versus hold-time after impregnation prior to expansion.

The effect of hold time after impregnation prior to expansion on expanded tobacco SV and equilibrated CV was studied in Runs 2132-1 thru 2135-2. In each of these runs, 2132-1, 2132-2, 2134-1, 2134-2, 2135-1, and 2135-2, 225 lbs. of bright tobacco with a 15% OV content was placed in the same pressure vessel as described in Example 1. The vessel was pressured to from about 250 psig to about 300 psig with carbon dioxide gas. The tobacco was then cooled, while maintaining the vessel pressure at about 250 psig to about 300 psig, in the same manner as described in Example 1. The vessel was then pressurized to about 800 psig with carbon dioxide gas. This pressure was maintained for about 60 seconds before the vessel was vented to atmospheric pressure in about 300 seconds. The impregnated tobacco was maintained in an environment with a dewpoint below the tobacco postvent temperature prior to expansion. FIG. 11 illustrates the effect of hold time after impregnation on the specific volume of expanded tobacco. FIG. 12 illustrates the effect of hold time after impregnation on the equilibrated CV of expanded tobacco.

EXAMPLE 2

A 19 pound sample of bright tobacco filler with a 15% OV content was placed in a 3.4 cubic foot pressure vessel. The vessel was then pressured to about 185 psig with carbon dioxide gas. The tobacco was then cooled, while maintaining the vessel pressure at about 185 psig, to about −25° F. by flushing with carbon dioxide gas near saturated conditions for about 5 minutes prior to pressurizing to about 430 psig with carbon dioxide gas. The vessel pressure was maintained at about 430 psig for about 5 minutes. The vessel pressure was decreased to atmospheric pressure by venting in about 60 seconds, after which the tobacco temperature was found to be about −29° F. Based on the tobacco temperature, the system pressure, temperature, and volume, it was calculated that approximately 0.23 lbs. of carbon dioxide condensed per lb. of tobacco.

The impregnated sample had a weight gain of about 2% which is attributable to the carbon dioxide impregnation. The impregnated tobacco was then, over a one hour period, exposed to heating in an 3-inch diameter expansion tower by contact with a 100% steam at about 525° F. and a velocity of about 135 ft/sec for less than about 2 seconds. The product exiting the expansion tower had an OV content of about 3.8%. The product was equilibrated at standard conditions of 75° F. and 60% RH for about 24 hours. The filling power of the equilibrated product was measured by the standardized cylinder volume (CV) test. This gave an equilibrated CV value of 10.1 cc/g at an equilibrium moisture of 11.0%. An unexpanded control was found to have a cylinder volume of 5.8 cc/g at an equilibrium moisture of 11.6%. The sample after processing, therefore, had a 74% increase in filling power as measured by the CV method.

The term "cylinder volume" is a unit for measuring the degree of expansion of tobacco. As used throughout this application, the values employed, in connection with these terms are determined as follows:

Cylinder Volume (CV)

Tobacco filler weighing 20 grams, if unexpanded, or 10 grams, if expanded, is placed in a 6-cm diameter Densimeter cylinder, Model No. DD-60, designed by the Heinr. Borgwaldt Company, Heinr. Borgwaldt GmbH, Schnackenburgallee No. 15, Postfach 54 07 02, 2000 Hamburg 54 West Germany. A 2 kg piston, 5.6 cm in diameter, is placed on the tobacco in the cylinder for 30 seconds. The resulting volume of the compressed tobacco is read and divided by the tobacco sample weight to yield the cylinder volume as cc/gram. The test determines the apparent volume of a given weight of tobacco filler. The resulting volume of filler is reported as cylinder volume. This test is carried out at standard environmental conditions of 75° F. and 60% RH; conventionally, unless otherwise stated, the sample is preconditioned in this environment for 24–48 hours.

Specific Volume (SV)

The term "specific volume" is a unit for measuring the volume and true density of solid objects, e.g., tobacco, using the fundamental principles of the ideal gas law. The specific volume is determined by taking the inverse of the density and is expressed as "cc/g". A weighed sample of tobacco, either "as is", dried at 100° C. for 3 hours, or equilibrated, is placed in a cell in a Quantachrome Penta-Pycnometer. The cell is then purged and pressured with helium. The volume of helium displaced by the tobacco is compared with the volume of helium required to fill an empty sample cell and the tobacco volume is determined based on Archimedes' principle. As used throughout this application, unless stated to the contrary, specific volume was determined using the same tobacco sample used to determine OV, i.e., tobacco dried after exposure for 3 hours in a circulating air oven controlled at 100° C.

While the invention has been particularly shown and described with reference to preferred embodiments, it will be understood by those skilled in the art that various changes in form and details may be made without departing from the spirit and scope of the invention. For example, as size of the equipment used to impregnate the tobacco varies the time required to reach the desired pressure, or to vent, or to adequately cool the tobacco bed will vary.

We claim:

1. A process for expanding tobacco comprising the steps of:
   (a) contacting the dioxide gas at a pressure of from about 400 psig to about 1057 psig and at a temperature such that the carbon dioxide gas is at or near saturated conditions;
   (b) allowing the tobacco to contact the carbon dioxide for a time sufficient to impregnate the tobacco with carbon dioxide;
   (c) releasing the pressure;
   (d) thereafter subjecting the tobacco to conditions such that the tobacco is expanded; and
   (e) prior to step (a), removing a sufficient amount of heat from the tobacco to cause a controlled amount of carbon dioxide to condense on the tobacco such that the tobacco is cooled to a temperature of from about −35° F. to about 30° F. after releasing the pressure in step (c).

2. The process of claim 1 wherein the tobacco has an initial OV content of from about 12% to about 21%.

3. The process of claim 1 wherein the tobacco has an initial OV content of from about 13% to about 16%.

4. The process of claim 2 wherein the step of contacting the tobacco with carbon dioxide is conducted at a pressure of from about 650 psig to about 950 psig.

5. The process of claim 2 wherein step (e), removing a sufficient amount of heat from the tobacco to cause a controlled amount of carbon dioxide to condense on the tobacco includes pre-cooling the tobacco prior to contacting the tobacco with the carbon dioxide in step (a).

6. The process of claim 2 wherein step (e), removing a sufficient amount of heat from the tobacco to cause a controlled amount of carbon dioxide to condense on the tobacco includes pre-cooling the tobacco in situ.

7. The process of claim 6 wherein step (e), removing a sufficient amount of heat from the tobacco to cause a controlled amount of carbon dioxide to condense on the tobacco includes subjecting the tobacco to a partial vacuum prior to contacting the tobacco with the carbon dioxide in step (a).

8. The process of claim 6 wherein step (e), removing a sufficient amount of heat from the tobacco to cause a controlled amount of carbon dioxide to condense on the tobacco includes flowing through the tobacco with carbon dioxide gas.

9. The process of claim 8 wherein step (e), removing a sufficient amount of heat from the tobacco to cause a controlled amount of carbon dioxide to condense on the tobacco includes subjecting the tobacco to a partial vacuum.

10. The process of claim 2 wherein step (e), removing a sufficient amount of heat from the tobacco to cause a controlled amount of carbon dioxide to condense on the tobacco includes cooling the tobacco to at least about 10° F. prior to step (a).

11. The process of claim 2 wherein the tobacco is allowed to remain in contact with the carbon dioxide for a period of from about 1 second to about 300 seconds.

12. The process of claim 2 wherein step (c), releasing the pressure, is carried out over a period of from about 1 second to 300 seconds.

13. The process of claim 2 wherein from a negligible amount to about 0.5 pound of carbon dioxide per pound of tobacco is condensed on the tobacco.

14. The process of claim 2 further comprising the step of maintaining the impregnated tobacco in an atmosphere with a dewpoint no greater than the temperature of the tobacco after releasing the pressure in step (c), prior to subjecting the tobacco to conditions such that the tobacco is expanded.

15. The process of claim 2 wherein the tobacco is expanded by heating in an environment maintained at a temperature of from about 300° F. to about 800° F. for a period of from about 0.1 second to about 5 seconds.

16. The process of claim 13 wherein from about 0.1 pound to about 0.5 pound dioxide per pound of tobacco is condensed on the tobacco.

17. The process of claim 1 wherein said step of removing a sufficient amount of heat from the tobacco to cause a controlled amount of carbon dioxide to condense on the tobacco is carried out such that the tobacco is cooled to a temperature of from about −35° F. to about 20° F. after releasing the pressure in step (c).

18. A process for expanding tobacco having an initial OV content of from about 13% to about 16% comprising the steps of:
   (a) contacting the tobacco with carbon dioxide gas at a pressure of from about 300 psig to about 550 psig and at a temperature such that the carbon dioxide gas is at or near saturated conditions;
   (b) while maintaining the pressure of the carbon dioxide gas in contact with the tobacco at from about 300 psig to about 550 psig, cooling the tobacco sufficiently to cause a controlled amount of the carbon dioxide to condense on the tobacco prior to releasing the pressure in step (e), such that the tobacco will be cooled to a temperature of from about −10° F. to about 30° F. after releasing the pressure in step (e);

(c) increasing the pressure of the carbon dioxide gas in contact with the tobacco to from about 750 psig to about 950 psig while maintaining the carbon dioxide at or near saturated conditions;

(d) allowing the tobacco to contact the carbon dioxide for a time sufficient to impregnate the tobacco with carbon dioxide;

(e) releasing the pressure; and (f) thereafter subjecting the tobacco to conditions such that the tobacco is expanded.

19. The process of claim 18 wherein the tobacco cooling of step (b) includes flowing through the tobacco with carbon dioxide gas.

20. The process of claim 18 further comprising the step of removing heat from the tobacco prior to contacting the tobacco with carbon dioxide gas in step (a).

21. The process of claim 20 wherein heat is removed from the tobacco prior to contacting the tobacco with carbon dioxide gas in step (a) by subjecting the tobacco to a partial vacuum.

22. The process of claims 18, 19, 20, or 21 wherein the tobacco temperature is less than about 10° F. after releasing the pressure in step (e).

23. The process of claim 22 further comprising the step of maintaining the impregnated tobacco in an atmosphere with a dewpoint no greater than the temperature of the tobacco after releasing the pressure in step (e), prior to subjecting the tobacco to conditions such that the tobacco is expanded.

24. The process of claim 18 wherein step (f), subjecting the tobacco to conditions such that the tobacco is expanded comprises contacting the tobacco with a fluid selected from the group consisting of steam, air, and a combination thereof, at about 350° F. to about 550° F. for less than about 4 seconds.

25. The process of claims 18, 19, 20, or 21 wherein from about 0.1 pound to about 0.9 pound of carbon dioxide per pound of tobacco is condensed on the tobacco.

26. The process of claims 18, 19, 20, or 21 wherein from about 0.1 pound to about 0.3 pound of carbon dioxide per pound of tobacco is condensed on the tobacco.

27. The process of claim 18 wherein the step of cooling the tobacco sufficiently to cause a controlled amount of the carbon dioxide to condense on the tobacco, prior to releasing the pressure in step (e), is carried out such that the tobacco is cooled to a temperature of from about −10° F. to about 20° F. after releasing the pressure in step (e).

28. A process for expanding tobacco having an initial OV content of from about 13% to about 16% comprising the steps of:

(a) pre-cooling the tobacco sufficiently to cause a controlled amount of carbon dioxide to condense on the tobacco prior to releasing the pressure in step (d);

(b) contacting the tobacco with carbon dioxide gas at a pressure from about 750 psig to about 950 psig while maintaining the carbon dioxide at or near saturated conditions;

(c) allowing the tobacco to contact the carbon dioxide for a time sufficient to impregnate the tobacco with carbon dioxide;

(d) releasing the pressure; and (e) thereafter subjecting the tobacco to conditions such that the tobacco is expanded.

29. The process of claim 28 wherein the tobacco temperature is less than about 10° F. after the pressure is released in step (d).

30. The process of claim 28, wherein the pre-cooling step (a) is carried out so that the temperature of the tobacco is at or above about −70° F. during the carbon dioxide gas contacting step (b).

31. A process for expanding tobacco having an initial OV content of from about 13% to about 16% comprising the steps of:

(a) pre-cooling the tobacco sufficiently that the tobacco temperature is less than about 10° F. after the pressure is released in step (d);

(b) contacting the tobacco with carbon dioxide gas at a pressure from about 750 psig to about 950 psig while maintaining the carbon dioxide at or near saturated conditions;

(c) allowing the tobacco to contact the carbon dioxide for a time sufficient to impregnate the tobacco with carbon dioxide;

(d) releasing the pressure;

(e) thereafter subjecting the tobacco to conditions such that the tobacco is expanded; and (f) maintaining the impregnated tobacco in an atmosphere with a dewpoint no greater than the temperature of the tobacco after releasing the pressure in step (d), prior to subjecting the tobacco to conditions such that the tobacco is expanded.

32. The process of claim 31 wherein step (e), subjecting the tobacco to conditions such that the tobacco is expanded comprises contacting the tobacco with a fluid selected from the group consisting of steam, air, and a combination thereof, at about 350° F. to about 550° F. for less than about 4 seconds.

33. A process for expanding tobacco having an initial OV content of from about 13% to about 16% comprising the steps of:

(a) pre-cooling the tobacco;

(b) contacting the tobacco with carbon dioxide gas at a pressure from about 750 psig to about 950 psig while maintaining the carbon dioxide at or near saturated conditions;

(c) allowing the tobacco to contact the carbon dioxide for a time sufficient to impregnate the tobacco with carbon dioxide;

(d) releasing the pressure; and (e) thereafter subjecting the tobacco to conditions such that the tobacco is expanded, wherein from about 0.1 pound to about 0.3 pound of carbon dioxide per pound of tobacco is condensed on the tobacco.

34. A process for expanding tobacco having an initial OV content of from about 15% to about 19% comprising the steps of:

(a) cooling the tobacco sufficiently to cause a controlled amount of carbon dioxide to condense on the tobacco prior to releasing the pressure in step (d), wherein the cooling comprises subjecting the tobacco to a partial vacuum in situ, whereby the tobacco is cooled and the OV content of the tobacco is lowered;

(b) contacting the tobacco with carbon dioxide gas at a pressure from about 750 psig to about 950 psig while maintaining the carbon dioxide at or near saturated conditions;

(c) allowing the tobacco to contact the carbon dioxide for a time sufficient to impregnate the tobacco with carbon dioxide;
(d) releasing the pressure; and
(e) thereafter subjecting the tobacco to conditions such that the tobacco is expanded.

35. The process of claim 34 wherein the tobacco temperature is less than about 10° F. after the pressure is released.

36. The process of claim 34 wherein said cooling step further comprises flowing carbon dioxide gas through the tobacco after subjecting the tobacco to a partial vacuum.

37. A process for expanding tobacco having an initial OV content of from about 15% to about 19% comprising the steps of:
(a) cooling the tobacco and lowering the OV of the tobacco in situ by subjecting the tobacco to a partial vacuum;
(b) contacting the tobacco with carbon dioxide gas at a pressure from about 750 psig to about 950 psig while maintaining the carbon dioxide at or near saturated conditions;
(c) allowing the tobacco to contact the carbon dioxide for a time sufficient to impregnate the tobacco with carbon dioxide;
(d) releasing the pressure, wherein the tobacco temperature is less than about 10° F. after the pressure is released;
(e) thereafter subjecting the tobacco to conditions such that the tobacco is expanded; and
(f) maintaining the impregnated tobacco in an atmosphere with a dewpoint no greater than the temperature of the tobacco after releasing the pressure in step (d), prior to subjecting the tobacco to conditions such that the tobacco is expanded.

38. The process of claim 37 wherein step (e), subjecting the tobacco to conditions such that the tobacco is expanded comprises contacting the tobacco with a fluid selected from the group consisting of steam, air, and a combination thereof, at about 350° F. to about 550° F. for less than about 4 seconds.

39. The process of claim 38 wherein from about 0.1 pound to about 0.3 pound of carbon dioxide per pound tobacco is condensed on the tobacco.

40. A process for expanding tobacco comprising the steps of:
(a) contacting the tobacco with carbon dioxide gas;
(b) increasing the pressure of the carbon dioxide gas contacting the tobacco from a first pressure to a second pressure;
(c) prior to the completion of the pressure increasing step (b), removing a sufficient amount of heat from the tobacco to cause the tobacco to have a temperature at or below the saturation temperature of the carbon dioxide gas contacting the tobacco, but not lower than about −70° F., during at least a portion of the remainder of step (b);
(d) releasing the pressure;
(e) thereafter subjecting the tobacco to conditions such that the tobacco is expanded.

41. The process of claim 40, wherein the second pressure is from about 400 psig to about 950 psig.

42. The process of claim 41, wherein the second pressure is from about 750 psig to about 950 psig.

43. The process of claim 40, wherein the heat removing step (c) is carried out while the carbon dioxide gas contacting the tobacco is at or below about 550 psig in pressure.

44. The process of claim 40, wherein the pressure increasing step (b) and the heat removing step (c) cooperate to cause a controlled amount of carbon dioxide to condense on the tobacco prior to releasing the pressure in step (d), such that the tobacco will be at a temperature of from about −35° F. to about 30° F. after releasing the pressure in step (d).

45. The process of claim 40, wherein the heat removing step (c) includes flowing through the tobacco an amount of carbon dioxide gas additional to the amount necessary to carry out the pressure increasing step (b).

46. The process of claim 40, wherein the tobacco has an initial OV content of from about 13% to about 16%.

47. The process of claim 40, wherein the heat removing step (c) is carried out at a substantially constant preselected pressure not lower than the first pressure and lower than the second pressure.

48. The process of claim 47, wherein the preselected pressure is at or below about 550 psig.

49. The process of claim 40, wherein the tobacco is cooled to or below about 30° F. during the heat removing step (c).

50. The process of claim 49, wherein the tobacco is cooled to or below about 10° F. during the heat removing step (c).

51. The process of claim 50, wherein the tobacco is cooled to or below −10° F. during the heat removing step (c).

52. The process of claim 40, wherein the tobacco is cooled to between about −25° F. and about 30° F. during the heat removing step (c).

53. The process of claim 40, wherein from about 0.1 pound to about 0.6 pound of carbon dioxide per pound of tobacco is condensed on the tobacco before releasing the pressure in step (d).

54. A process for expanding tobacco comprising the steps of:
(a) contacting tobacco with carbon dioxide gas;
(b) increasing the pressure of the carbon dioxide gas contacting the tobacco from a first pressure to a second pressure;
(c) at least at a preselected pressure in the range between the first pressure and the second pressure, flowing carbon dioxide gas through the tobacco to cool the tobacco to the saturation temperature of carbon dioxide gas at the preselected pressure;
(d) condensing carbon dioxide on the tobacco during at least a portion of the pressure increasing step (b) after completion of the flow-through cooling step (c);
(e) releasing the pressure; and
(f) thereafter subjecting the tobacco to conditions such that the tobacco is expanded.

55. The process of claim 54, wherein the second pressure is from about 400 psig to about 950 psig.

56. The process of claim 54, wherein the first pressure is about atmospheric pressure.

57. The process of claim 54, wherein the preselected pressure is a substantially constant pressure at or below about 550 psig.

58. The process of claim 54, wherein from about 0.1 to about 0.6 pound of carbon dioxide per pound of tobacco is condensed on the tobacco before releasing the pressure in step (e).

59. A process for expanding tobacco comprising the steps of:

(a) contacting the tobacco with carbon dioxide gas;
(b) increasing the pressure of the carbon dioxide gas contacting the tobacco from a first pressure to a second pressure;
(c) during the pressure increasing step (b), removing a sufficient amount of heat from the tobacco to cause the tobacco to have a temperature at or below the saturation temperature of the carbon dioxide gas contacting the tobacco during at least a portion of the remainder of step (b);
(d) releasing the pressure;
(e) thereafter subjecting the tobacco to conditions such that the tobacco is expanded.

60. The process of claim 59, wherein the second pressure is from about 400 psig to about 950 psig.

61. The process of claim 60, wherein the second pressure is from about 750 psig to about 950 psig.

62. The process of claim 59, wherein the heat removing step (c) is carried out while the carbon dioxide gas contacting the tobacco is at or below about 550 psig in pressure.

63. The process of claim 59, wherein the pressure increasing step (b) and the heat removing step (c) cooperate to cause a controlled amount of carbon dioxide to condense on the tobacco prior to releasing the pressure in step (d), such that the tobacco will be at a temperature of from about −35° F. to about 30° F. after releasing the pressure in step (d).

64. The process of claim 59, wherein the heat removing step (c) includes flowing through the tobacco an amount of carbon dioxide gas additional to the amount necessary to carry out the pressure increasing step (b).

65. The process of claim 59, wherein the tobacco has an initial OV content of from about 13% to about 16%.

66. The process of claim 59, wherein the heat removing step (c) is carried out at a substantially constant preselected pressure greater than the first pressure and lower than the second pressure.

67. The process of claim 66, wherein the preselected pressure is below about 550 psig.

68. The process of claim 59, wherein the tobacco is cooled to or below about 30° F. during the heat removing step (c).

69. The process of claim 68, wherein the tobacco is cooled to or below about 10° F. during the heat removing step (c).

70. The process of claim 69, wherein the tobacco is cooled to or below −10° F. during the heat removing step (c).

71. The process of claim 59, wherein the tobacco is cooled to between about −25° F. and about 30° F. during the heat removing step (c).

72. The process of claim 59, wherein from about 0.1 pound to about 0.6 pound of carbon dioxide per pound of tobacco is condensed on the tobacco before releasing the pressure in step (d).

* * * * *

UNITED STATES PATENT AND TRADEMARK OFFICE

CERTIFICATE OF CORRECTION

PATENT NO. : 5,251,649

DATED : October 12, 1993

INVENTOR(S) : Kwang H. Cho et al.

It is certified that error appears in the above-indentified patent and that said Letters Patent is hereby corrected as shown below:

Claim 1, column 15, line 41, after "contacting the" insert --tobacco with carbon--.

Signed and Sealed this

Twenty-sixth Day of July, 1994

*Attest:*

*Attesting Officer*

BRUCE LEHMAN

*Commissioner of Patents and Trademarks*